US005425209A

United States Patent [19]

Funaki

[11] Patent Number: 5,425,209

[45] Date of Patent: Jun. 20, 1995

[54] DEVICE FOR INCORPORATING LAYER MEMBER IN FACE CONSTRUCTION OF BUILDING

[75] Inventor: Motokatsu Funaki, Kanagawa, Japan

[73] Assignees: Gantan Beauty Kogyo K.K.; Gantan Beauty Industry Co., Ltd., Japan

[21] Appl. No.: 251,000

[22] Filed: May 31, 1994

Related U.S. Application Data

[60] Continuation of Ser. No. 124,373, Sep. 20, 1993, abandoned, which is a continuation of Ser. No. 990,818, Dec. 14, 1993, abandoned, which is a continuation of Ser. No. 638,470, Jan. 7, 1991, abandoned, which is a division of Ser. No. 546,007, Oct. 27, 1983, Pat. No. 4,982,542.

[30] Foreign Application Priority Data

| | | | |
|---|---|---|---|
| Jan. 15, 1983 | [JP] | Japan | 58-2904 |
| Mar. 19, 1983 | [JP] | Japan | 58-39054 U |
| Mar. 23, 1983 | [JP] | Japan | 58-40767 U |
| Dec. 22, 1992 | [JP] | Japan | 57-193070 U |

[51] Int. Cl.[6] ..... E04B 9/00

[52] U.S. Cl. ..... 52/359; 52/309.1; 52/483.1

[58] Field of Search ..... 52/357–363, 52/481.2, 483.1, 489.1, 506.01, 509, 764, 588.1, 309.1

[56] References Cited

U.S. PATENT DOCUMENTS

| | | | |
|---|---|---|---|
| 1,258,906 | 3/1918 | Jester | 52/359 |
| 1,638,668 | 8/1927 | Volk | 52/463 |
| 1,789,827 | 1/1931 | McKay | 52/764 |
| 1,858,715 | 5/1932 | McKay | 52/359 |
| 1,998,688 | 4/1935 | Robinson et al. | 52/275 |
| 2,161,185 | 6/1939 | Mills | 52/486 |
| 2,164,414 | 7/1939 | Long | 29/522.1 |
| 2,499,278 | 2/1950 | Olsen | 52/309.1 |
| 2,671,538 | 3/1954 | Horowitz et al. | 52/433 |
| 3,017,673 | 1/1962 | Biris | 52/471 |
| 3,080,021 | 5/1963 | Muir | 52/471 |
| 3,143,939 | 8/1964 | Gregoire | 52/588 |
| 3,232,018 | 2/1966 | MacKean | 52/489 |
| 3,553,915 | 1/1971 | Passovoy | 52/359 |
| 3,561,182 | 2/1971 | Madl, Jr. | 52/665 |
| 3,703,794 | 11/1972 | Gracon et al. | 52/506 |
| 3,981,067 | 9/1976 | Oiler | 29/572.1 |
| 4,163,350 | 8/1979 | Doguchi et al. | 52/483 |
| 4,266,384 | 5/1981 | Orals et al. | 52/665 |
| 4,280,484 | 7/1981 | Mancosu | 52/506 |
| 4,442,647 | 4/1984 | Olsen | 52/506 |
| 4,982,542 | 1/1991 | Funaki | 52/401 |

FOREIGN PATENT DOCUMENTS

| | | | |
|---|---|---|---|
| 1371274 | 7/1964 | France | 52/509 |
| 133177 | 8/1902 | Germany | 52/463 |
| 3024764 | 1/1982 | Germany | 52/665 |
| 2018340 | 10/1979 | United Kingdom | 52/509 |

*Primary Examiner*—Carl D. Friedman
*Assistant Examiner*—Beth A. Aubey
*Attorney, Agent, or Firm*—Stroock & Stroock & Lavan

[57] ABSTRACT

A device for incorporating a layer member in a face construction of a building which is capable of employing a soft or flexible layer member as well as a rigid one, improving operation efficiency, ensuring safe operation at a height, and readily and precisely positioning and fixing a layer member in a face construction. The device comprises a base element, a connecting element mounted on the base element and a holding element mounted through the connecting element on the base element, the base element being adapted to be held on a supporting member of a building and hold a layer member in cooperation with the connecting and holding elements. The device may include a mounting member mounted on the holding element.

16 Claims, 19 Drawing Sheets

DEVICE FOR INCORPORATING LAYER MEMBER IN FACE CONSTRUCTION OF BUILDING

This is a continuation of application Ser. No. 08/124,373, filed Sep. 20, 1993, now abandoned, which is a continuation of application Ser. No. 07/990,818, filed Dec. 14, 1993, now abandoned, which is a continuation of application Ser. No. 07/638,470, filed Jan. 7, 1991, now abandoned, which is a divisional of application Ser. No. 06/546,007, filed Oct. 27, 1983 which issued as U.S. Pat. No. 4,982,542.

BACKGROUND OF THE INVENTION

1. Field of the Invention

This invention relates to a device for incorporating a layer member in a face construction of a building, and more particularly to a device for incorporating a layer member formed of a heat insulating material, a sound absorbing material, a combination thereof or the like in a face construction of a building such as a roof, an outer wall, a ceiling or the like with simple and safe operation.

1. Description of the Prior Art

The mounting of an inner layer member and/or an outer layer member in a face construction of a building such as a roof, an outer wall, a ceiling or the like has been conventionally carried out for the purpose of heat insulation, sound absorption and the like. Such conventional mounting procedure has been generally carried out in a manner to support a layer member on a supporting member of a building such as an H-shaped steel or a roof purlin, insert a bolt means partially embedded in the supporting member through the layer member, and tighten the bolt with a nut to fix the layer member with respect to the supporting member.

Unfortunately, such conventional procedure has a disadvantage of necessarily requiring the use of a hard layer material having a high strength such as a cemented excelsior board, because it is substantially impossible to incorporate in a face construction a layer member of a soft or flexible material which has excellent heat insulating and/or sound absorbing characteristics and is not weighty.

More particularly, the conventional procedure has mainly used only a thick, rigid and heavy member such as a cemented excelsior board as a layer member for a face construction. The use of such board requires troublesome operation which comprises the steps of forming the excelsior board supported on a supporting member with a plurality of through-holes and securely fixing the board with respect to the supporting member via the through-holes by means of a bolt and nut assembly by group work, because the excelsior board is hard and weighty and there is no means for readily and simply fixing the board onto the supporting member.

The conventional procedure has another disadvantage that it is very difficult to precisely position a layer member in a face construction.

A further disadvantage encounted with the prior art is that it necessarily requires the use of an electric power drill at a height such as a roof or the like, accordingly, there is a fear that a lead wire of the drill often catches an operator's foot to expose the operator to danger of falling.

Still a further disadvantage of the prior art is that a large load is locally applied to a layer member because the layer member is held on a supporting member by means of a hook bolt.

The present invention has been made in view of the foregoing disadvantages of the prior art.

Accordingly, it is an object of the present invention to provide a device for incorporating a layer member in a face construction of a building which is capable of employing a soft or flexible layer member having excellent sound absorbing and/or heat insulating characteristics as well as a hard layer member such as a cemented excelsior board.

It is another object of the present invention to provide a device for incorporating a layer member in a face construction of a building which is capable of incorporating various kinds of layer members in the face construction.

It is another object of the present invention to provide a device for incorporating a layer member in a face construction of a building which is capable of significantly improving operation efficiency and ensuring safe operation at a height.

It is a further object of the present invention to provide a device for incorporating a layer member in a face construction of a building which is capable of readily and precisely positioning and fixing a layer member with respect to the face construction.

In accordance with the present invention, there is provided a device for incorporating a layer member in a face construction of a building which comprises a base element, a connecting element mounted on the base element and a holding element mounted through the connecting element on the base element; the base element being adapted to be held on a supporting member of a building and hold a layer member in cooperation with the connecting element and holding element. The device according to the present invention may further comprise a mounting member fixedly mounted on the holding element which is adapted to support at least a face member.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate the same or similar parts throughout the figures thereof and wherein.

DETAILED DESCRIPTION OF THE PREFERRED EMBODIMENTS

Now, a device for incorporating a layer member in a face construction of a building according to the present invention will be described hereinafter with reference to the accompanying drawings.

Figure 1:
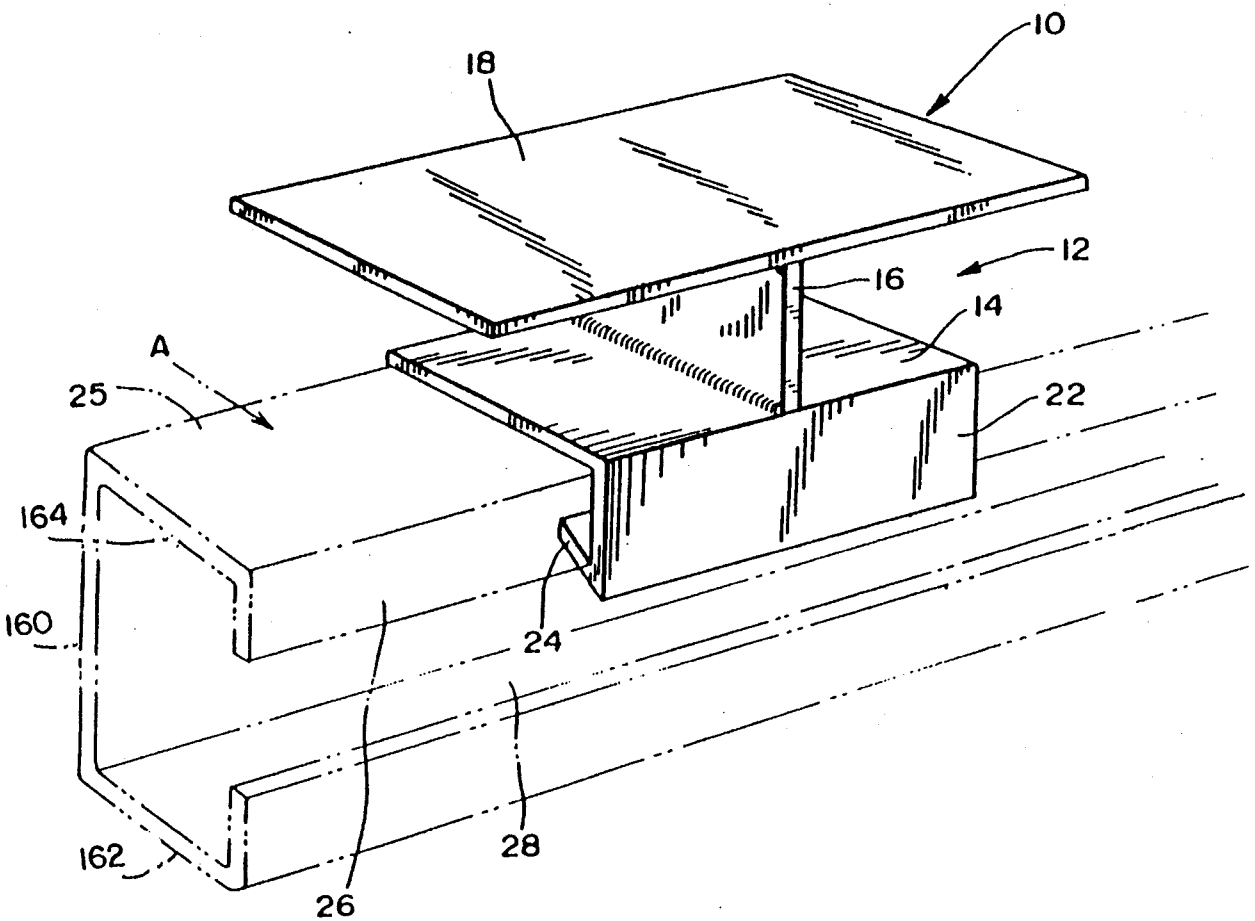
FIG. 1 is a perspective view illustrating one embodiment of a device for incorporating a layer member in a face construction of a building according to the present invention.

FIG. 1 illustrates one embodiment of a device for incorporating a layer member in a face construction of a building according to the present invention, wherein the device is generally designated by reference numeral 10. The device of the illustrated embodiment comprises a holding member 12 which acts to hold an inner layer member. The holding member 12 includes a base element or base plate 14 which is adapted to be held on a supporting member A of a building comprising, for example, a C-shaped steel. The base plate 14 has a connecting element or rising element 16 fixedly mounted on the central portion thereof which extends upwardly therefrom. In the embodiment, the connecting element 16 is formed of a plate and extends in the direction perpendicular to the longitudinal direction of the base plate. The holding member 12 also includes a holding element or holding plate 18 extending in parallel with the base plate 14 and fixedly mounted through the connecting plate 16 on the base plate 14, with a space being formed between the base plate 14 and the holding plate 18 which acts to hold a layer member 20 such as an inner layer member (FIG. 2) therein in such a manner as described hereinafter. The holding plate 18 is fixed at its central portion to the connecting plate 16 by any suitable means such as welding. The base plate 14 has a side plate portion 22 formed on one side thereof so as to downwardly extend therefrom.

The holding plate 18 is formed to have the substantially same width as the supporting member A and a length larger than that of the base plate 14. The connecting plate or rising plate 14 is formed to have the substantially same height as thickness of the layer member 20 to be incorporated. The side plate 22 has a hook 24 formed at the lower end portion thereof which is adapted to engage with an upper one of flanges 26 of the supporting member A of a C-shape defining an opening 28 therebetween to thereby fix the base plate 14 with respect to the supporting member A. As seen in FIG. 1, supporting member A has central wall 160 connecting upper wall 25 and lower wall 162. The end of hook 24 faces the lower side of upper wall 25, the upper side of upper wall 25 supporting base plate 14. In the illustrated embodiment, the hook 24 is formed by inwardly bending the lower end of the side plate 22. The holding member 12 may be integrally formed of a steel plate by welding. Alternatively, it may be formed of plastic by molding.

The manner of use of the device 10 according to the embodiment will be explained hereinafter with reference to FIGS. 2 and 3.

Figure 2:
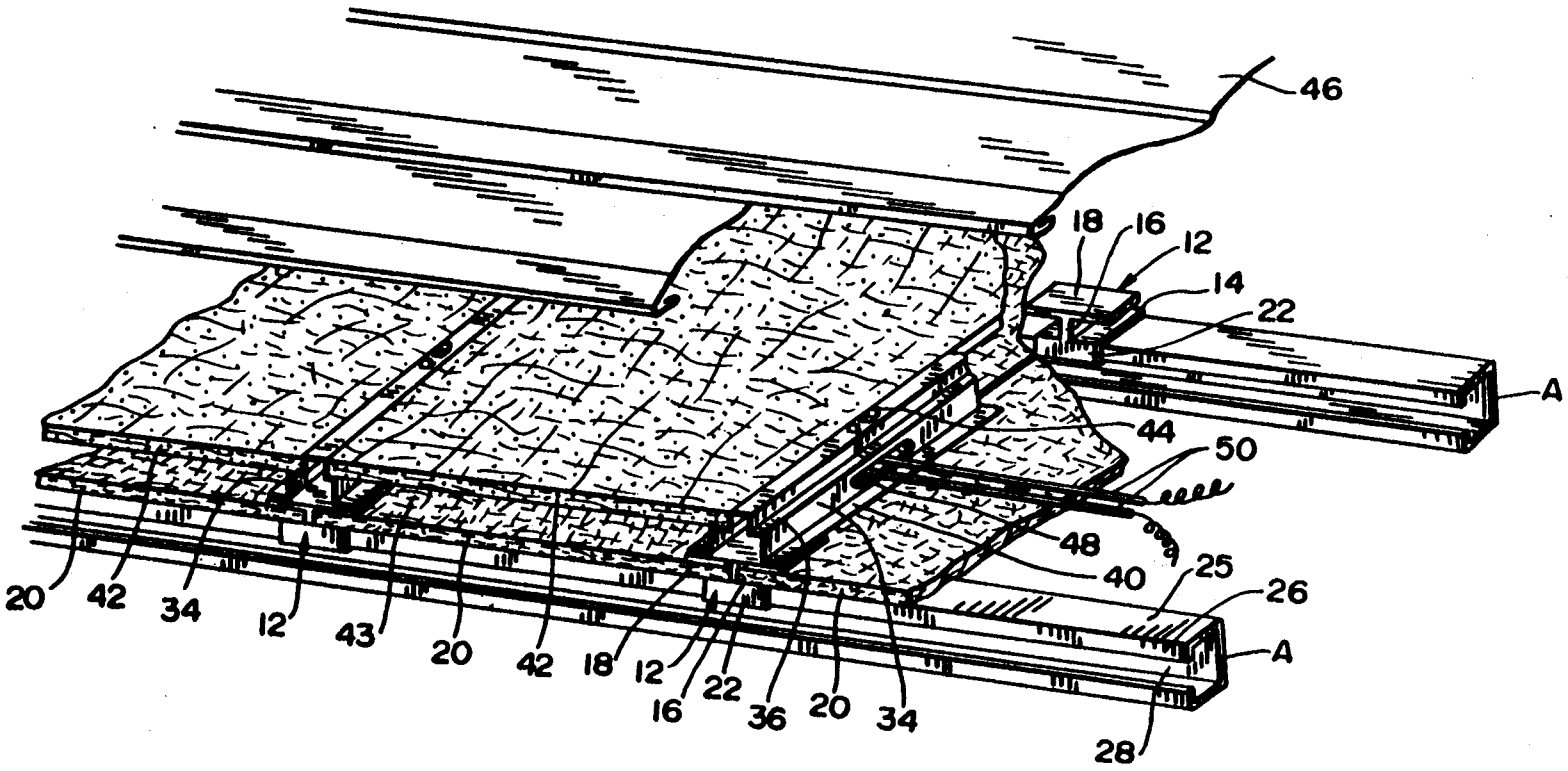
FIG. 2 is a partly broken perspective view showing an example wherein the device shown in FIG. 1 is used for the formation of a roof construction, and also showing another embodiment of a device for incorporating a layer member in a face construction of a building according to the present invention.
Figure 3:
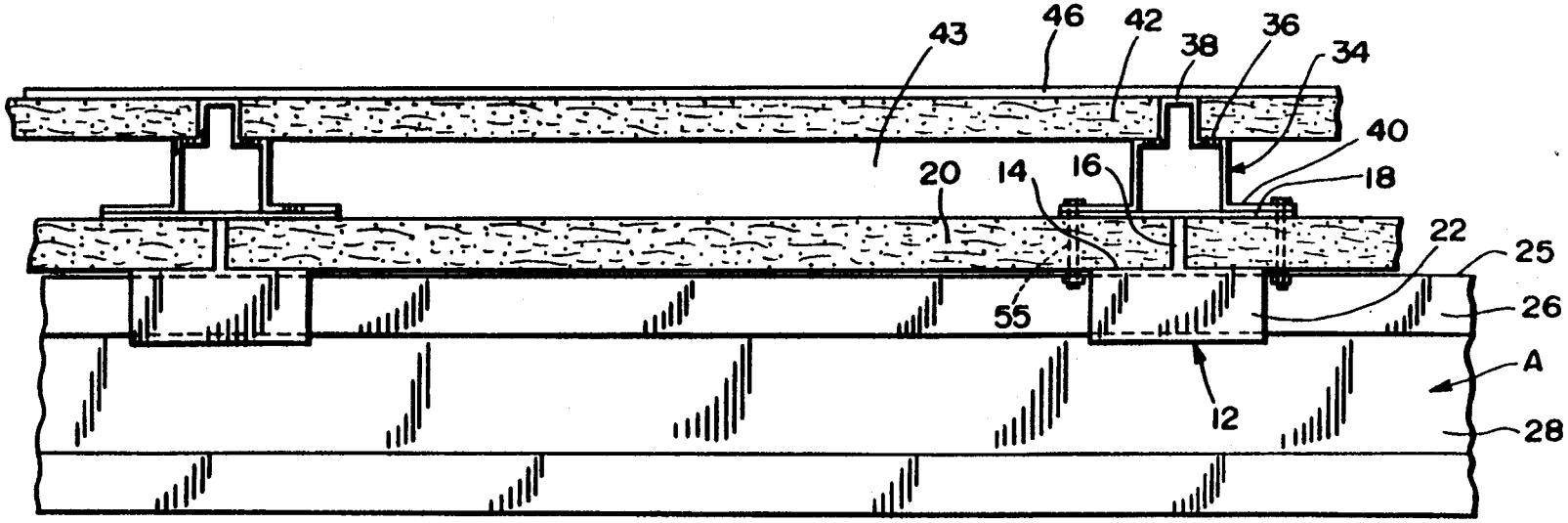
FIG. 3 is an elevation view showing the roof construction shown in FIG. 2.
Figure 4:
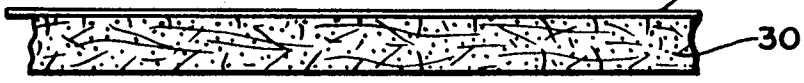
FIG. 4 is a partly enlarged view showing an inner layer member incorporated in the roof construction of FIG. 2.

In FIGS. 2 and 3, the device is used to incorporate an inner layer member in a roof construction. First, the device 10 is fixedly positioned and held on the C-shaped steel or supporting member A by allowing the hook 24 of the side plate 22 and the base plate 14 to securely clamp the upper wall portion 25 and upper flange 26 of the supporting member A therebetween. In this instance, the base plate 14 may be more securely fixed with respect to the supporting member A using bolting, welding or the like. Then, the layer member 20 is arranged between the connecting plates 14 of the adjacent devices in a manner to be interposed between the holding plate 18 and the base plate 14. The layer member 20 incorporated in a fare construction by the device of the embodiment may be formed of a soft material and/or a hard material. For example, it may comprise an excelsior board 30 and a felt 32 put on the board 30 so as to exhibit excellent heat insulating and sound absorbing characteristics, as shown in FIG. 4.

FIGS. 2 and 3 also illustrate another embodiment of a device for incorporating a layer member in a face construction according to the present invention. The device of the second embodiment comprises a holding member 12 constructed in the substantially same manner as that of the first embodiment shown in FIG. 1 and a mounting member 34. The mounting member 34 extends in the direction perpendicular to the supporting members A arranged in rows and is supported on the holding plate 18 of the member 12. The mounting member 34 also may be formed of metal or plastic. The member 34 is formed into a convex shape to have a pair of steps 36 and a flat top surface 38 and integrally provided at each of the lower end portions thereof with an outward flange 40 extending in the longitudinal direction thereof. The member 34 is fixedly supported on the holding member by fixing the flanges 40 onto the holding plate 18 by bolting or fixing the flanges 40 with respect to the base plate 14 utilizing a bolt 55 which is inserted through the flange 40, holding plate 18, inner layer member 20, base plate 14 into the inside of the supporting member A and tightened with a nut. It should be noted that the device 10 having the mounting member 34 constructed in the manner as described above is capable of supporting an outer layer member 42 of a heat insulating and/or sound absorbing material on the opposite steps 36 of the adjacent mounting members 34 and forming a heat-insulating and sound absorbing space 43 between the inner layer member 20 and the outer layer member 42, to thereby provide a wall construction with more excellent heat insulating and sound absorbing properties.

The mounting member 34 is provided on the flat top surface 38 with projecting pawls 44 (FIG. 2) which are formed by cutting and raising a part of the top surface 38 so as to act to securely hold a face member 46 such as an outer wall member, a roof member or the like on the mounting member 34. In the illustrated embodiment, the mounting member 34 is formed at the lower side walls thereof with through-holes 48 (FIG. 2) in a manner such that the through-holes 48 of the adjacent mounting members 34 positionally align with one another. The through-holes 48 act to support an interior wiring 50 extending within the space 43 in a relationship spaced from the layer members 20 and 42.

Figure 5:
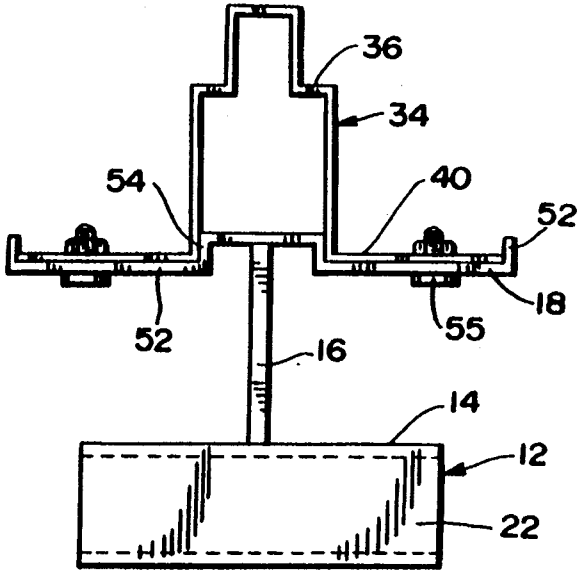
FIG. 5 is an elevation view showing a modification of the embodiment shown in FIGS. 2 and 3.

FIG. 5 illustrates a modification of the embodiment shown in FIGS. 2 and 3. In the modification, a holding element 18 of a holding member 12 is formed into a convex shape and has a upward projection 52 formed at each of the outer ends thereof so as to extend in the longitudinal direction thereof. A mounting member 34 is securely supported on the holding member 12 by holding flanges 40 between the projecting ends 52 and the projecting central portion 54 of the holding element 18 and fixing the former with respect to the latter by means of a bolt and nut assembly 55.

Figure 6:
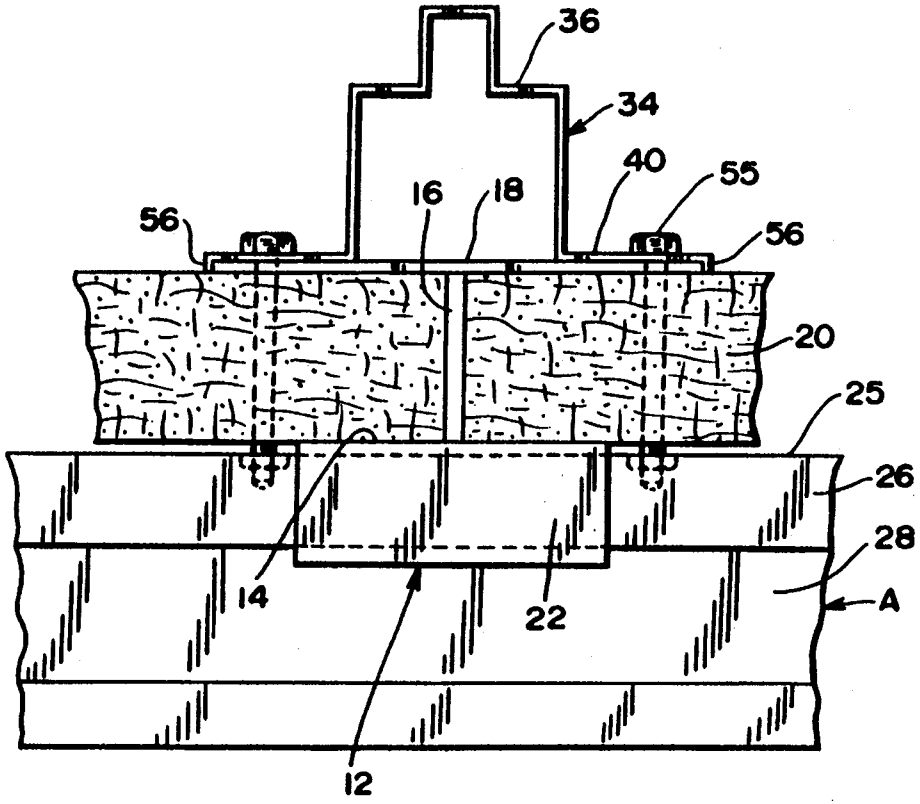
FIG. 6 is an elevation view showing another modification of the embodiment shown in FIGS. 2 and 3.

The embodiment shown in FIGS. 2 and 3 may be further modified as shown in FIG. 6. In this modification, each of flanges 40 of a mounting member 34 is formed at the outer end thereof with a downward projection 56, so that the positioning of the mounting member 34 with respect to a holding member 12 may be readily carried out substantially by engaging the projections 56 with the ends of a holding plate 18 of the holding member 12. The mounting member 34 is fixed on the holding member 12 by inserting a bolt 55 through the flange 40, the holding plate 18, an inner layer member 20 and the upper wall portion 25 of a supporting member A to the inside of the member A and securely tightening the bolt with a nut on the lower surface of the upper wall 25 of the member A.

Thus, it will be readily understood that the modifications shown in FIGS. 5 and 6 are adapted to facilitate the positioning of the mounting member with respect to the holding member.

Figure 7:
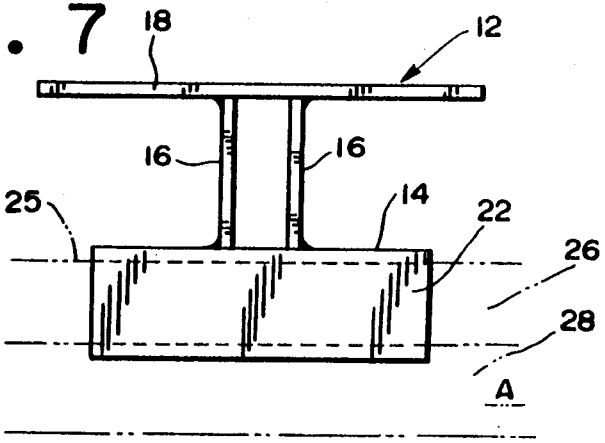
FIG. 7 is an elevation view showing a holding member in another modification of the device shown in FIGS. 2 and 3.

FIG. 7 shows a holding member in another modification of the device shown in FIGS. 2 and 3. The holding member 12 shown in FIG. 7 comprises a base plate 14 and a holding plate 18 which are constructed in the substantially same manner as those of FIG. 1 and a pair of connecting elements or plates 16 spaced from each other and vertically extending in parallel with each other. The device of the present modification is adapted to bear a larger load of a wall construction.

Figure 8:
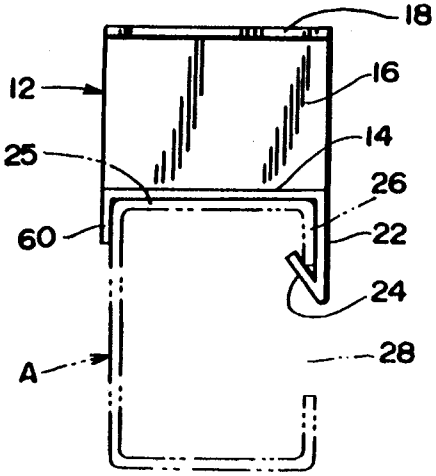
FIG. 8 is an elevation view showing another modification of the hiding member shown in FIG. 7.

FIG. 8 shows another modification of the device shown in FIGS. 2 and 3. In the modification, a holding member 12 is constructed in such a manner that a base plate 14 is formed at the end thereof opposite to a side plate 22 with a downwardly extending projection 60 of a small length, to thereby allow the base plate 14 to be more securely fixed on a supporting member A. The projection 60 may be provided along the entire longitudinal direction of the base plate 14.

Figure 9:
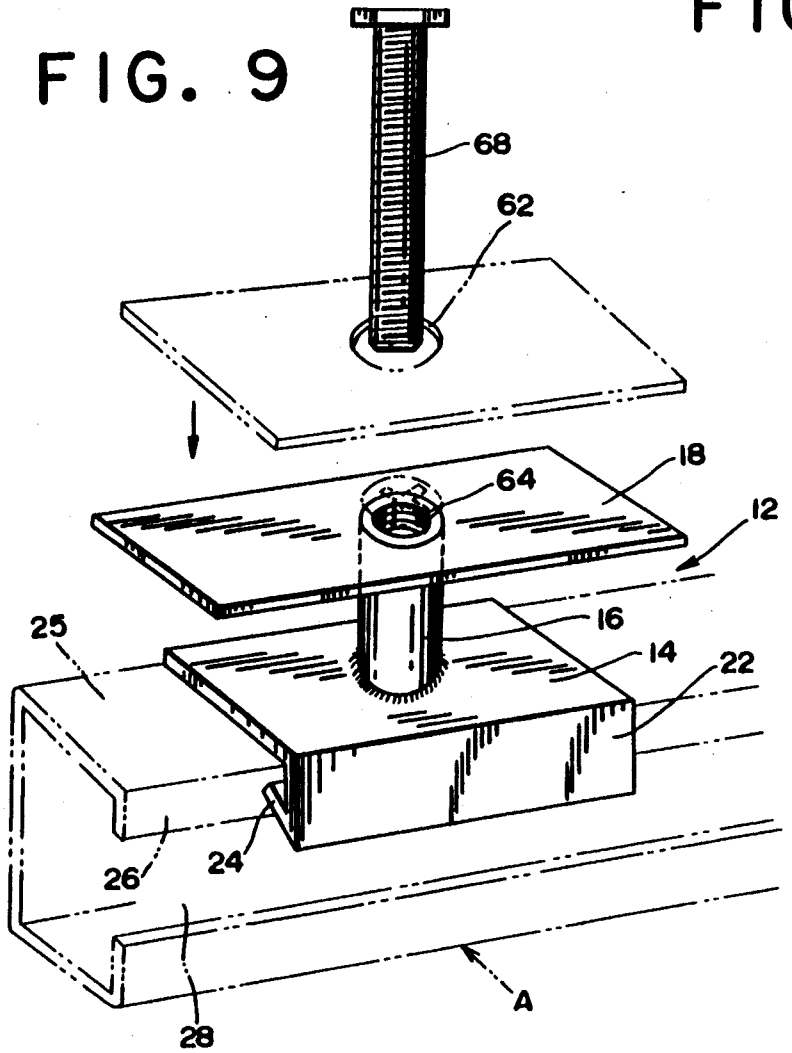
FIG. 9 is a perspective view showing a further modification of the device shown in FIGS. 2 and 3.

FIG. 9 shows a further modification of the device shown in FIGS. 2 and 3. In the present modification, a connecting element 16 is formed of a pipe and a holding plate 18 is detachably and loosely fitted at a through-hole 62 thereof on the pipe 16 having a screwed hole 64 formed therethrough. A base plate 14 is also formed with a through-hole (not shown) which is aligned with the through-hole 64 of the pipe 16. The device of FIG. 9 is fixed with respect to a supporting member A by fitting the holding plate 18 on the connecting pipe 16 and inserting a bolt 68 via the through-hole 64 and the through-hole of the base plate 14 to securely engage the head portion of the bolt 68 with the upper end of the pipe 16, to thereby clamp the base plate 14 with respect to the supporting member A. In the modification, it is preferable to provide a projection 60 at the side end portion of the base plate 14 opposite to a side plate 22 as in the modification of FIG. 8. The pipe is fixed at the lower end thereof with respect the base plate 14 by welding.

Figure 10:
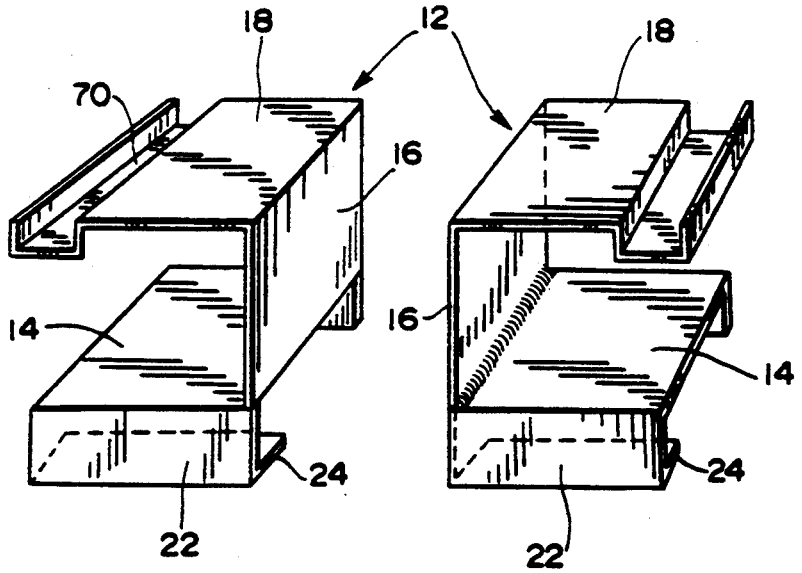
FIG. 10 is a perspective view showing a holding member in still a further modification of the device shown in FIGS. 2 and 3.
Figure 11:
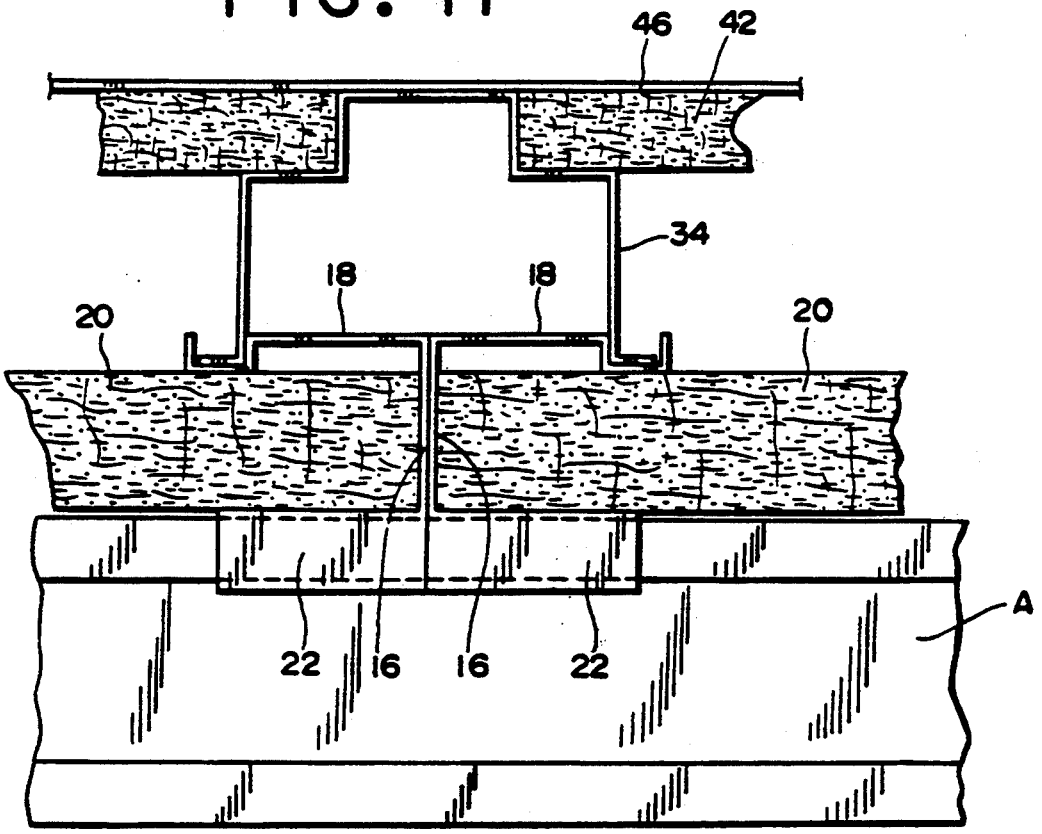
FIG. 11 is an elevation view showing an example wherein the modification of FIG. 10 is used for the formation of a roof construction.

FIGS. 10 and 11 illustrate still a further modification of the device shown in FIGS. 2 and 3. In the modification, a base plate 14, a holding element 18, a connecting element 16, a side plate 22 and a hook 24 forming a holding member 12 each comprise tow halves symmetrically formed. More particularly, the holding member 12 is divided into two parts about the connecting element 16. In the practical use, the two parts of the holding member 12 are aligned together as shown in FIG. 11 and a mounting member 34 is disposed on the holding element 18. In the modification, the holding element 18 is formed at the both side portions thereof with recesses 70 which are adapted to receive flanges 40 of the mounting member 34 therein, so that the mounting member may be fixed on the holding member 12 by screwing the flanges 40 of the mounting member in the recesses 70 of the holding member 12.

The device of the present invention illustrated in FIGS. 1 to 11 may be formed of a metal by welding. Alternatively, the device may be integrally formed of a rigid synthetic resin by molding in order to improve its heat insulating property. Also, the fixing between the inner layer member and the device and the fixing between the device and the supporting member may be carried out by means of a suitable means such as a bolt or the like, or by forced fitting or forced engagement without using such fixing means.

As can be seen from the forgoing, the device of the illustrated embodiment is constructed in the manner to fixedly connect the base plate with the holding element through the connecting element to provide a space between the base plate and the holding element which is sufficient to insert a plate-like inner layer member therein and engage the hook of the base plate with the supporting member, so that the device may effectively support the layer member without locally applying a load to the layer member, as compared with the conventional device constructed to support a layer member on a supporting member by means of a hook bolt. Also, the device is adapted to support the mounting member on the holding element of the holding member. Thus, it has a significant advantage of being capable of employing a wide variety of layer members formed of a soft material as well as a rigid material to provide good heat insulation, sound insulation, sound absorption, fire resistance and the like, as desired.

Further, the device of the present embodiment is capable of readily incorporating the layer member in a face construction, because it is easily positioned and supported between the adjacent connecting elements. Furthermore, the device can eliminate the use of an electric power drill at a height.

Figure 12:
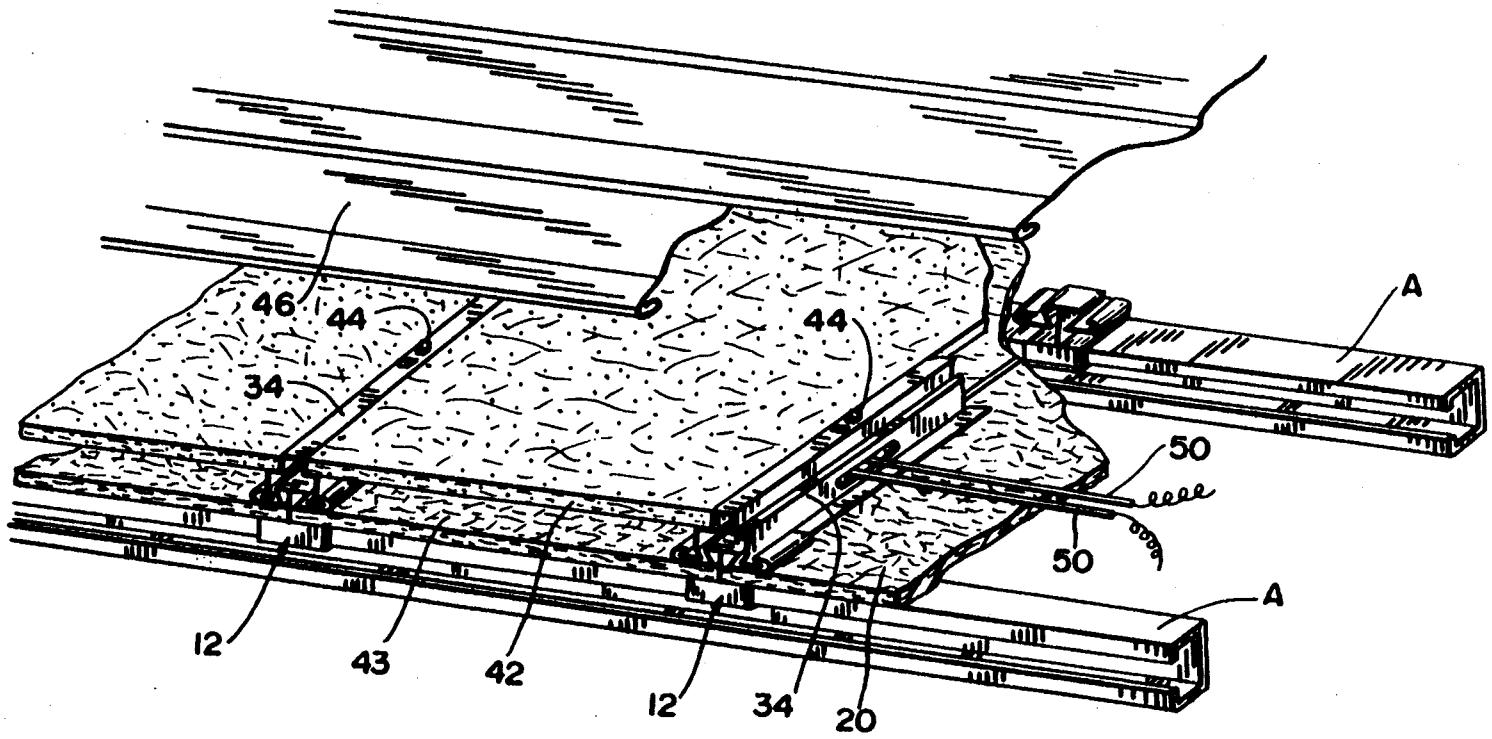
FIG. 12 is a perspective view showing another embodiment of a device for incorporating a layer member in a face construction of a building according to the present invention wherein the device is used for assembling a roof construction.
Figure 13:
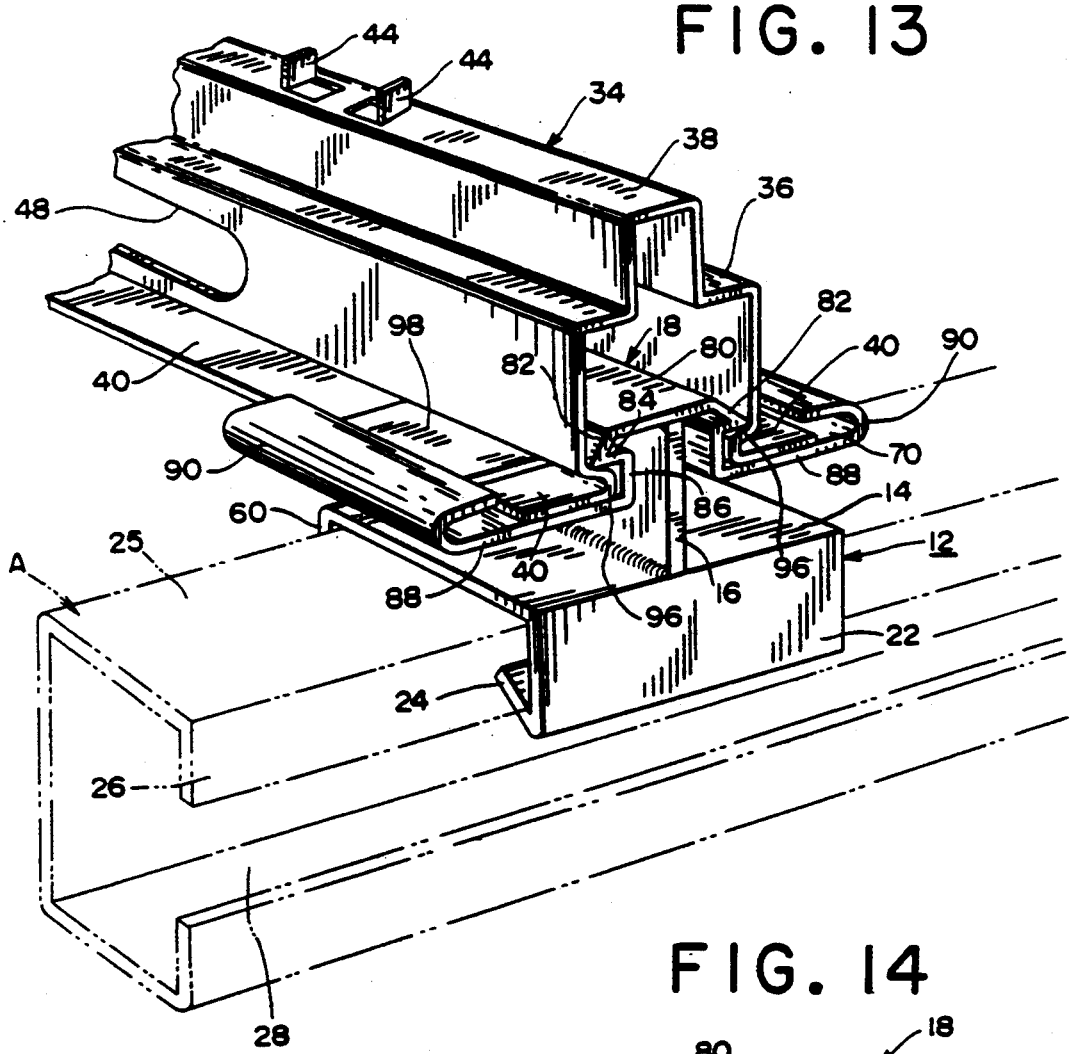
FIG. 13 is an enlarged perspective view showing the essential part of the device shown in FIG. 12.
Figure 14:
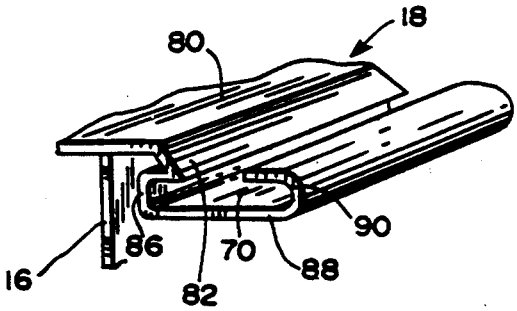
FIG. 14 is a partly broken perspective view showing a holding element of a holding member of the device shown in FIG. 12.

Another embodiment of a device for incorporating a layer member in a face construction of a building according to the present invention is illustrated in FIGS. 12 and 13. The embodiment shown in FIGS. 12 and 13 comprises a holding member 12 which is securely supported on a supporting member A (C-shaped steel) of a building such as a purlin or the like to hold an inner layer member, and a mounting member 34 securely supported on the holding member 12. The holding member 12 includes a base plate 14 held on the supporting member A, a connecting element or plate 16 fixedly mounted on the middle portion of the base plate 14 so as to upwardly extend therefrom and a holding element 18 fixedly mounted at the central portion thereof on the base plate 14 through the connecting plate 16. The base plate 14 has a side plate portion 22 formed on one side thereof which downwardly extends therefrom. The side plate 22 has a hook 24 formed at the lower end portion thereof which is adapted to engage with an upper one of flanges 26 of the C-shaped supporting member A defining an opening 28 therebetween to fix the base plate 14 on the supporting member A.

The holding element 18 is formed to have the substantially same width as the supporting member A and a length larger than that of the base plate 14. Also, the holding element 18 is symmetrically formed into a substantially omega (Ω)-shape. More particularly, the holding element has a flat top surface portion 80, a pair of obliquely outwardly descending portions or outwardly expanded portions 82 from the both sides of the flat top surface portion 80, a pair of horizontally inwardly extending portions 84 from the lower ends of the obliquely outwardly descending portions 82, a pair of downwardly extending portions 86 from the horizontally inwardly extending portions 84, a pair of flange portions 88 horizontally outwardly extending from the vertical portions 86, and a pair of upwardly bent or turned portions 90 formed at the outer ends of the flanges 88. The horizontally inwardly extending portion 84 and the downwardly extending portion 86 forms a constricted portion. The vertical portion 86, flanges 88 and upwardly turned portions 90 form together a pair of recesses 70 which are adapted to receive a pair of flanges 40 of the mounting member 34 described hereinafter. Each of the flange portions 88 is formed to allow a space to be defined between the flange 88 and the base plate 14 which has the substantially same height as an inner layer member so that it may be securely held at a part thereof in the space.

The base plate 14 is preferably provided at the side end thereof opposite to the side plate 22 with a downwardly extending projection 60 of a small length to allow the base plate 14 to be more effectively fixed with respect to the supporting member A. However, it should be noted that the base plate 14 is significantly fixed onto the supporting member A by means of only the hook 24 without forming such projection 60.

The mounting member 34 extends in the direction perpendicular to the supporting members A arranged in rows and is supported on the holding elements of the adjacent holding members 12. The mounting member 34 is formed into a substantially convex shape to have a pair of steps 36 and a flat top surface 38 and is formed at each of the lower end portions thereof with the flange 40 extending in the longitudinal direction thereof and adapted to be received in the recess 70. Each of the flanges 40 is preferably connected to the lower end of the convex-shaped portion of the mounting member 34 through an inwardly bent portion 96 interposed therebetween. In the embodiment, the mounting member 34 is formed into a one-step shape. However, it may be formed into a two or three-step shape, or the like. The mounting member 34 may be provided at the lower side walls thereof with through-holes 48 and is formed at the flat top surface 38 thereof with projecting pawls 44.

Figure 15:
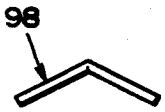
FIG. 15 is a side elevation view showing a stopper element used for fixing a mounting member onto a holding member in the device shown in FIG. 12.

Reference numeral 98 designates a stopper element made of a metal plate and formed into a doglegged shape as shown in FIG. 15. The stopper 98 is inserted at a part thereof into the inwardly bent portion 96 of the mounting member 34 received in the recess 70 of the holding element 34 and then hit with a hammer to be deformed into a flat shape, so that the stopper is stretched between the inwardly bent portion 96 of the mounting member 34 and the upwardly turned portion 90 of the holding element 18 to fix the mounting member 34 with respect to the holding member 12.

In the embodiment shown in FIGS. 12 and 13, the holding member 12 may be constructed in a manner to be divided into two parts about the connecting plate.

Figure 16:
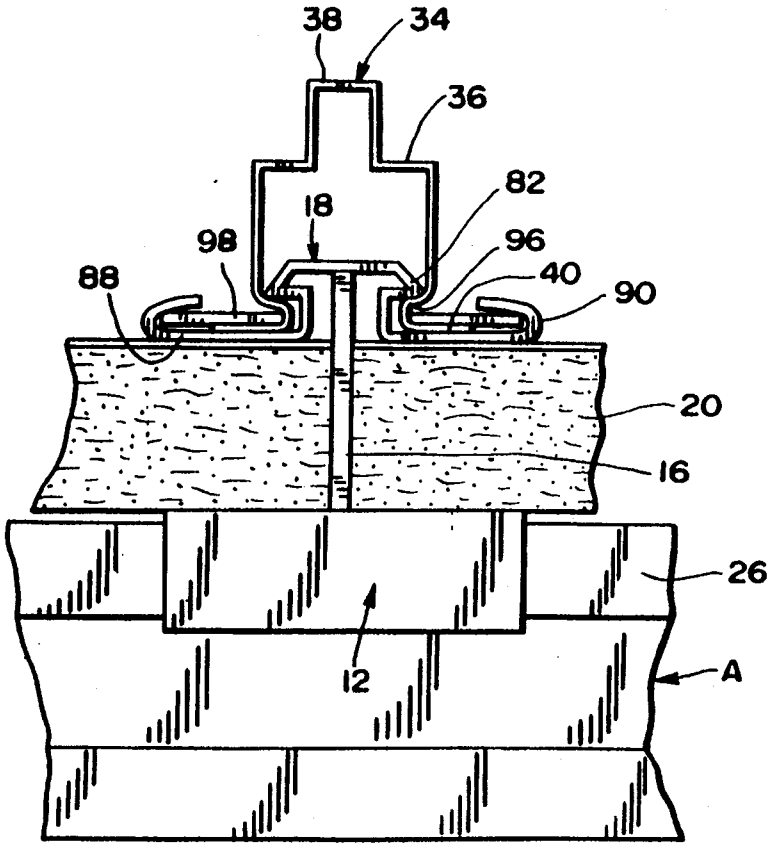
FIG. 16 an elevation view showing a modification of the device shown in FIG. 12.

An example wherein the device of the present embodiment shown in FIGS. 12 and 13 is used to incorporate a layer member in a roof construction of a building will be described with reference to FIGS. 12, 13 and 16.

First, the device is fixedly positioned on the C-shaped steel or supporting member A by allowing the hook 24 of the side plate 22 and the base plate 14 to securely clamp the upper wall portion 25 and upper flange 26 of the supporting member A therebetween. Then, an inner layer member 20 is arranged between the connecting plates 14 of the adjacent devices in a manner to be interposed between the holding element 18 and the base plate 14. As the inner layer member 20, both of plate-like soft and rigid members may be used which are formed of a heat insulating material, a sound absorbing material, a sound insulating material or the like, as desired. Then, each of the flanges 40 of the mounting member 34 is received in the corresponding recess 70 of the holding element 18 in such a manner that the inwardly bent portion 96 of the mounting member 34 is engaged with the lower end of the obliquely outwardly descending portion 82 of the holding element 18, and subsequently the stopper 98 is arranged on the flange 40 and hit with a hammer, to thereby allow the mounting member 34 to be fixed with respect to the holding member 12. The device may support an outer layer member 42 of a heat insulating and/or sound absorbing material on the opposite steps 36 of the adjacent mounting member 34 and form a heat insulating and sound absorbing space 43 between the inner layer member 20 and the outer layer member 42, to thereby provide a roof construction to be assembled with more excellent heat insulation and sound absorption. Finally, a roof member is held on the flat top surface 38 of the mounting member 34 by means of the projecting pawls 44. In FIG. 12, reference numeral 50 indicates an interior wiring stretching through the through-holes 48 of the mounting member 34.

Figure 17:
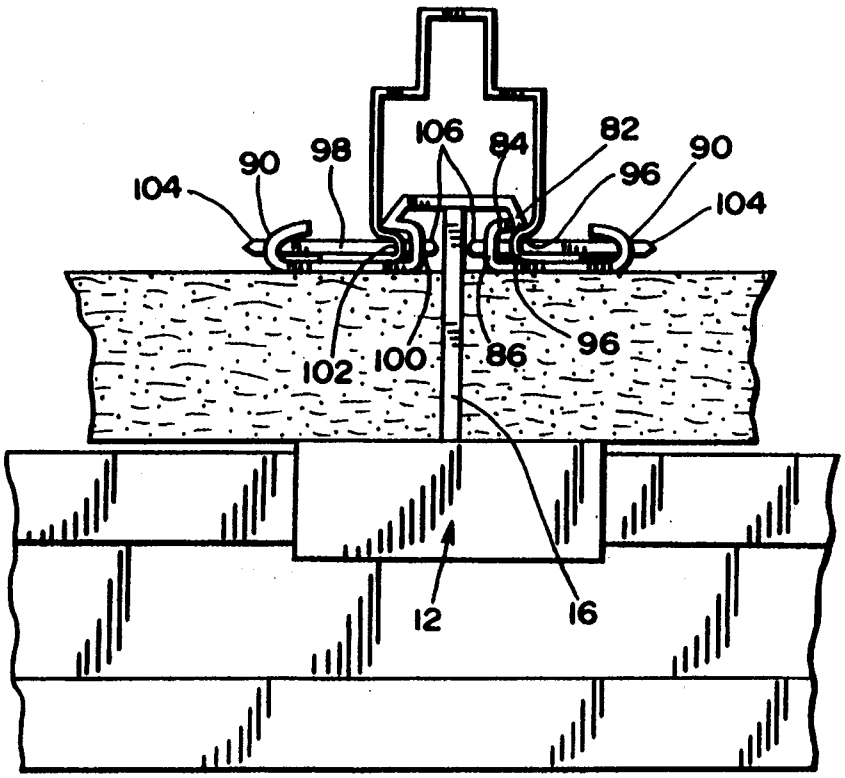
FIG. 17 is an elevation view showing another modification of the device shown in FIG. 12.
Figure 18:
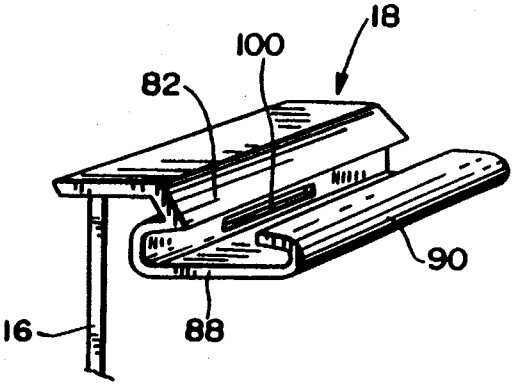
FIG. 18 is a partly broken perspective view showing a holding element in the device shown in FIG. 17.
Figure 19A:
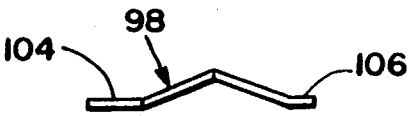
FIGS. 19A and 19B are a side view and a plan view showing a modification of the stopper element shown in FIG. 15, respectively.
Figure 19B:
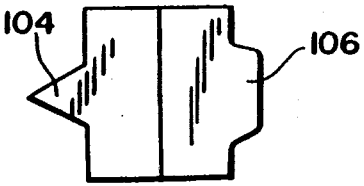

FIG. 17 shows a modification of the device shown in FIGS. 12 and 13. In the modification of FIG. 17, the downwardly extending portion 86 of a holding element 18 and the inwardly bent portion 96 of a mounting member 34 are respectively formed with through-holes 100 (FIG. 18) and 102; and correspondingly, a stopper element 98 is rendered acute and round at the both ends thereof, respectively, as shown in FIG. 19. When the stopper 98 is hit with a hammer, the acute end 104 outwardly penetrates the upwardly turned portion 90 of the holding element 18 and the roung end 106 projects via the through-holes 100 and 102; so that the mounting member 34 is securely fixed on the holding member 12.

Figure 20:
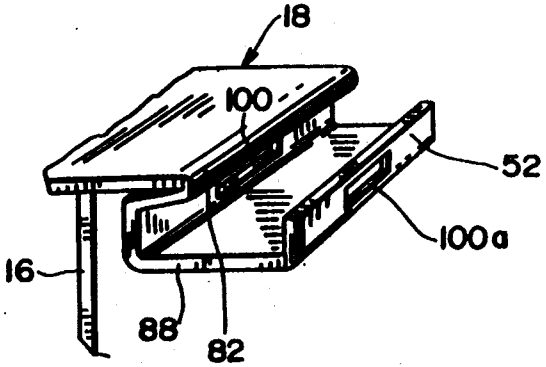
FIG. 20 is a partly broken perspective view showing a holding element in another modification of the device shown in FIG. 12.
Figure 21:
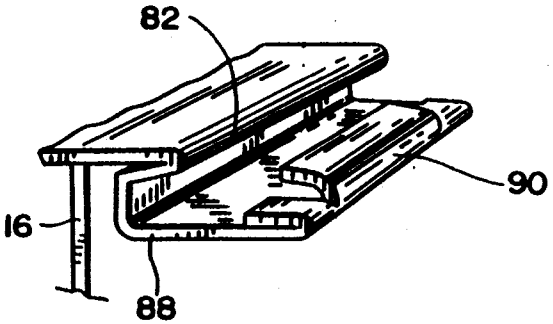
FIG. 21 is a partly broken perspective view showing a holding element in a further modification of the device shown in FIG. 12.

The holding element 18 of the holding member 12 in the embodiment shown in FIGS. 12 and 13 may be formed in such a manner as shown in FIG. 20 or 21. In FIG. 20, a holding element 18 is formed at the downwardly extending portion 86 and the upwardly turned portion 90 with through-holes 100 and 100*a*; and in FIG. 21, the upwardly turned portion 90 of the holding element 18 is folded at the both ends thereof.

Figure 22:
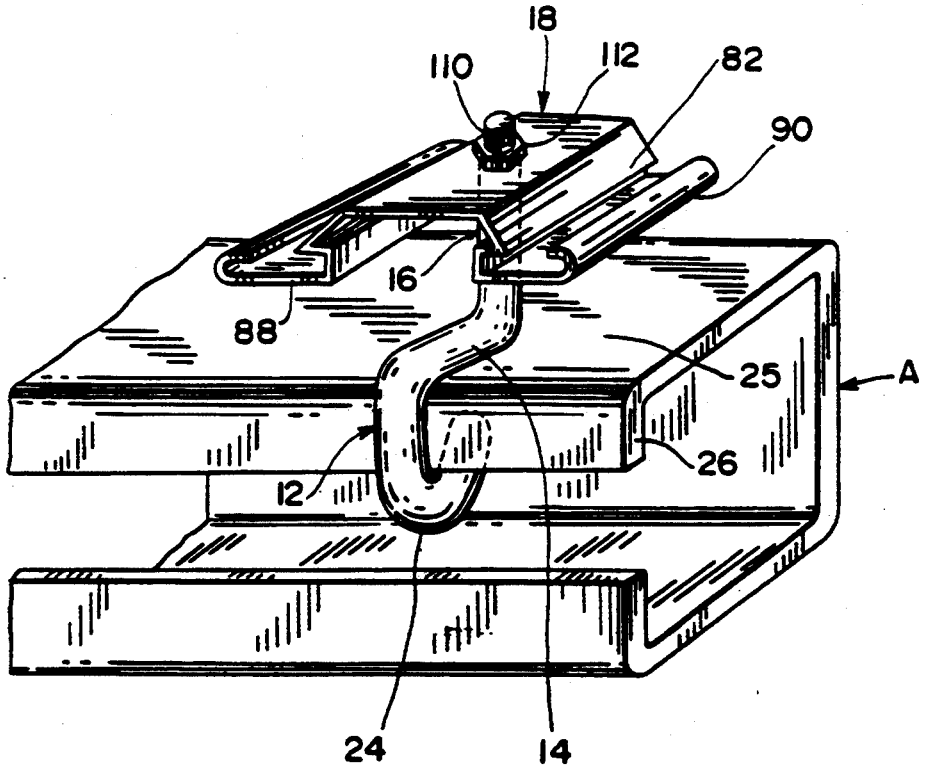
FIG. 22 is a perspective view showing a holding member in another modification of the device shown in FIG. 12.

FIG. 22 shows another modification of the device shown in FIGS. 12 and 13. In this modification, a base element 14 is made of a metal or plastic rod and formed integral with a connecting element 16. The connecting rod 16 is formed at the upper end thereof with a screwed portion 110 on which a holding element 18 is fitted at a through-hole (not shown) formed at the substantially central portion thereof on the screwed portion 110 and securely fixed on the rod 16 by means of a nut 112.

Figure 24:
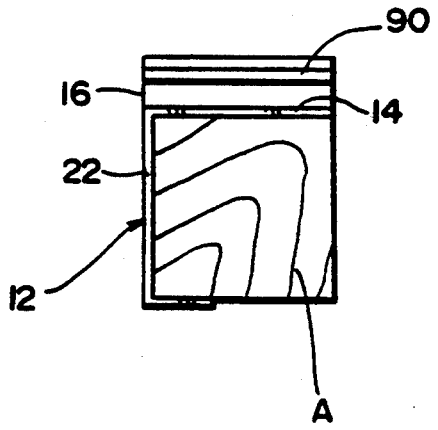
FIG. 24 is a side elevation view showing an example wherein a holding member in still a further modification of the device shown in FIG. 12 is supported on a wooden purlin.
Figure 23:
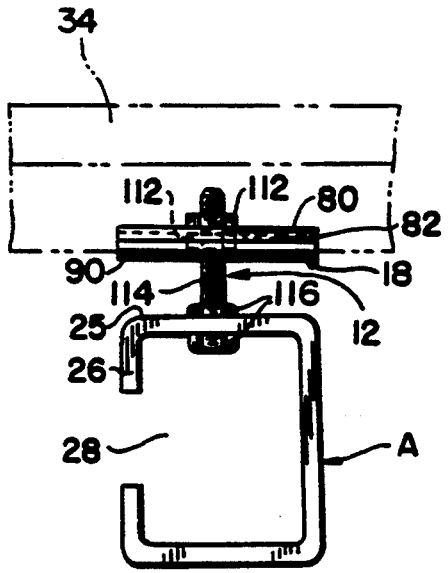
FIG. 23 is a side elevation view showing a holding member in a further modification of the device shown in FIG. 12.
Figure 23A:
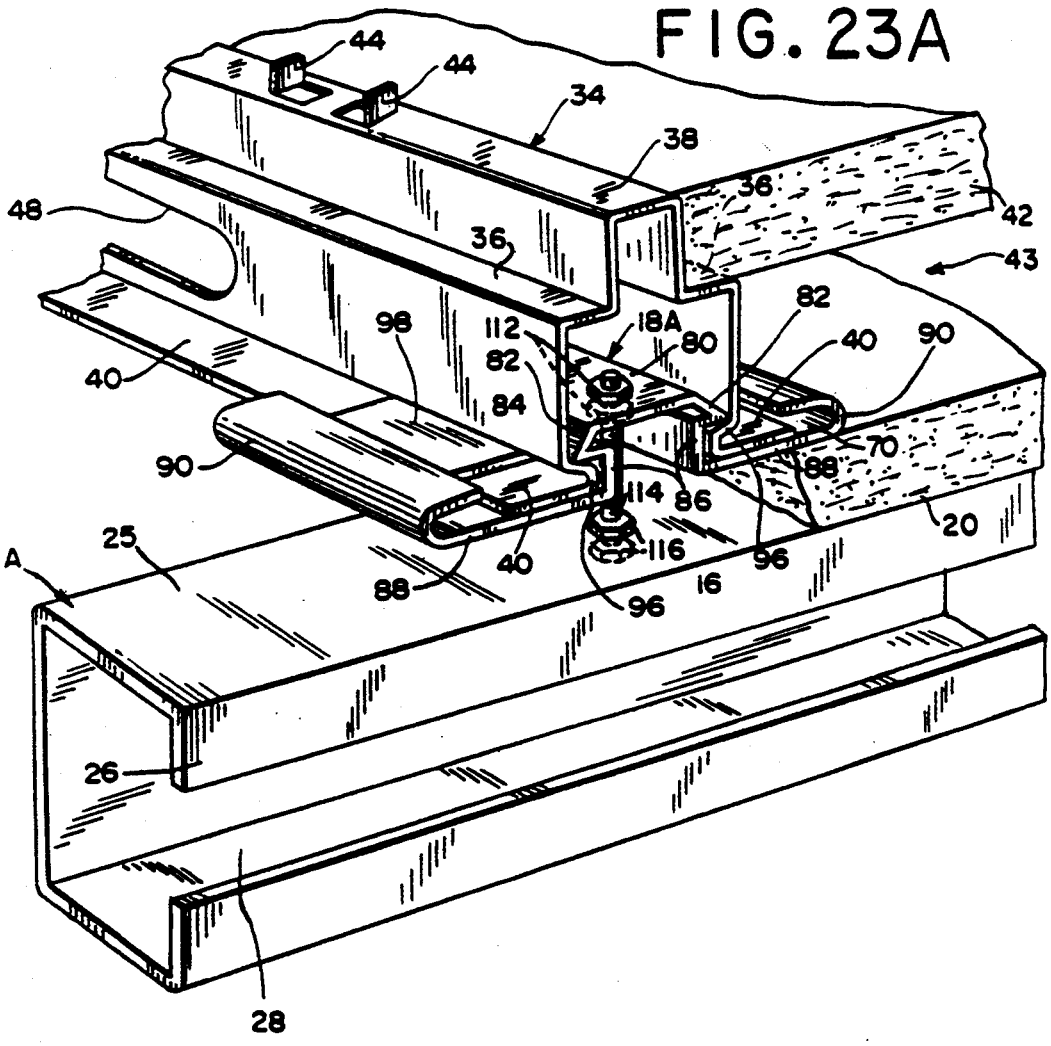
FIG. 23*a* is a perspective view showing the holding member of FIG. 23 and a device shown in FIG. 12.

FIG. 23 shows a further modification of the device shown in FIGS. 12 and 13. Holding element 12 is formed of a bolt 114 and two pairs of double nuts 116 and 112. Holding element 12 of FIG. 23 is securely supported on supporting member A by lower double nut 116 and fixedly mounts holding element 18 by upper double nut 112. Supporting member A and holding member 18 are the same as those shown in FIGS. 12 and 13 and are described in detail in connection therewith. Furthermore, the device of FIGS. 12 and 13 may be modified as shown in FIG. 24, in which a wooden purlin is used as a supporting member A and a side plate 22 is rectangularly bent at the lower end to hold the supporting member A in cooperation with a base plate 14.

As can be seen from the foregoing, in the embodiment of FIGS. 12 to 24, the mounting member 34 is readily and effectively fixed with respect to the holding member 12 only by press-fitting the mounting member in the holding member and then hitting the stopper inserted in the engaging portion between the both members with a hammer. This allows a face construction such as a wall, a roof or the like to be easily assembled utilizing the device of the present embodiment, because troublesome operation of pressing the mounting member by one hand and fixing it with respect to the holding member by the other hand is not required. Also, the present device is capable of significantly improving operation efficiency because the mounting member is readily fitted in the holding member only by pressing. Further, when the mounting member and/or holding member are formed with the through-holes for inserting the stopper therethrough, the mounting member is more securely fixed to the holding member.

Thus, the present embodiment allows an inner layer member formed of a soft material as well as a hard material to be used, accordingly, it can effectively provide a face construction to be assembled with good heat insulation, sound absorption, sound insulation, fire resistance or the like as desired. Furthermore, the device of the embodiment can be readily fixed on the supporting member only by simple hooking operation and significantly resist the external force.

Figure 25:
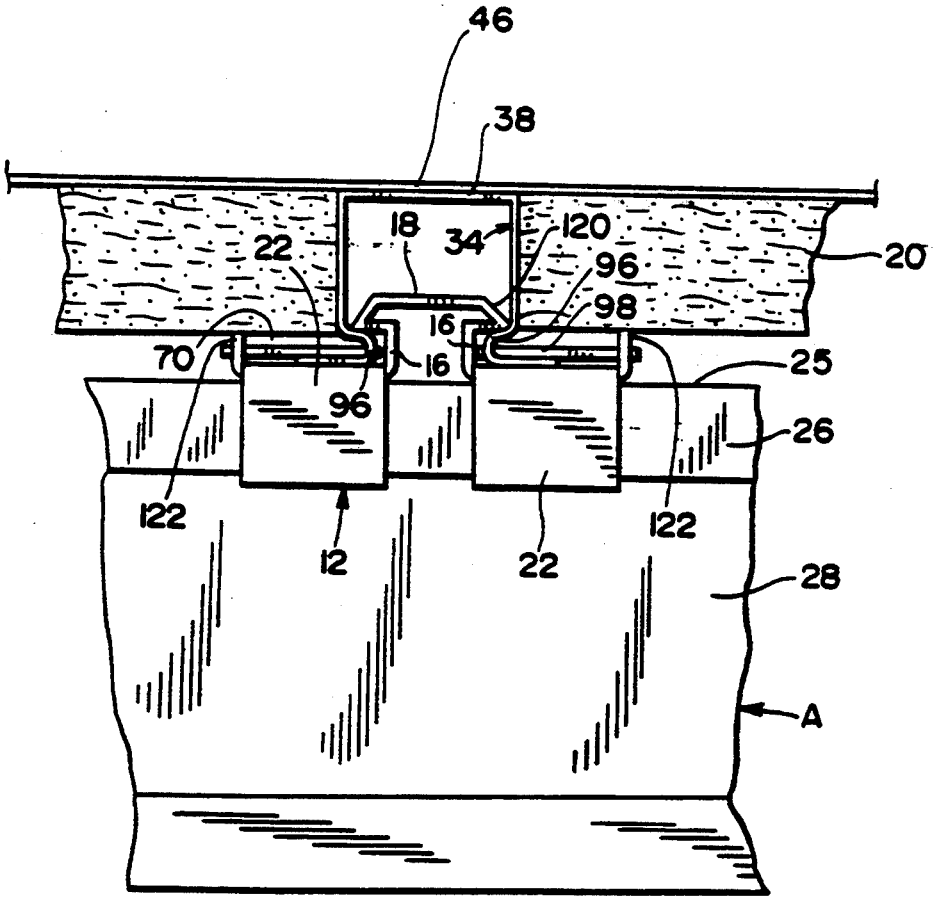
FIG. 25 is a elevation view showing a further embodiment of a device for incorporating a layer member in a face construction of a building according to the present invention.
Figure 26:
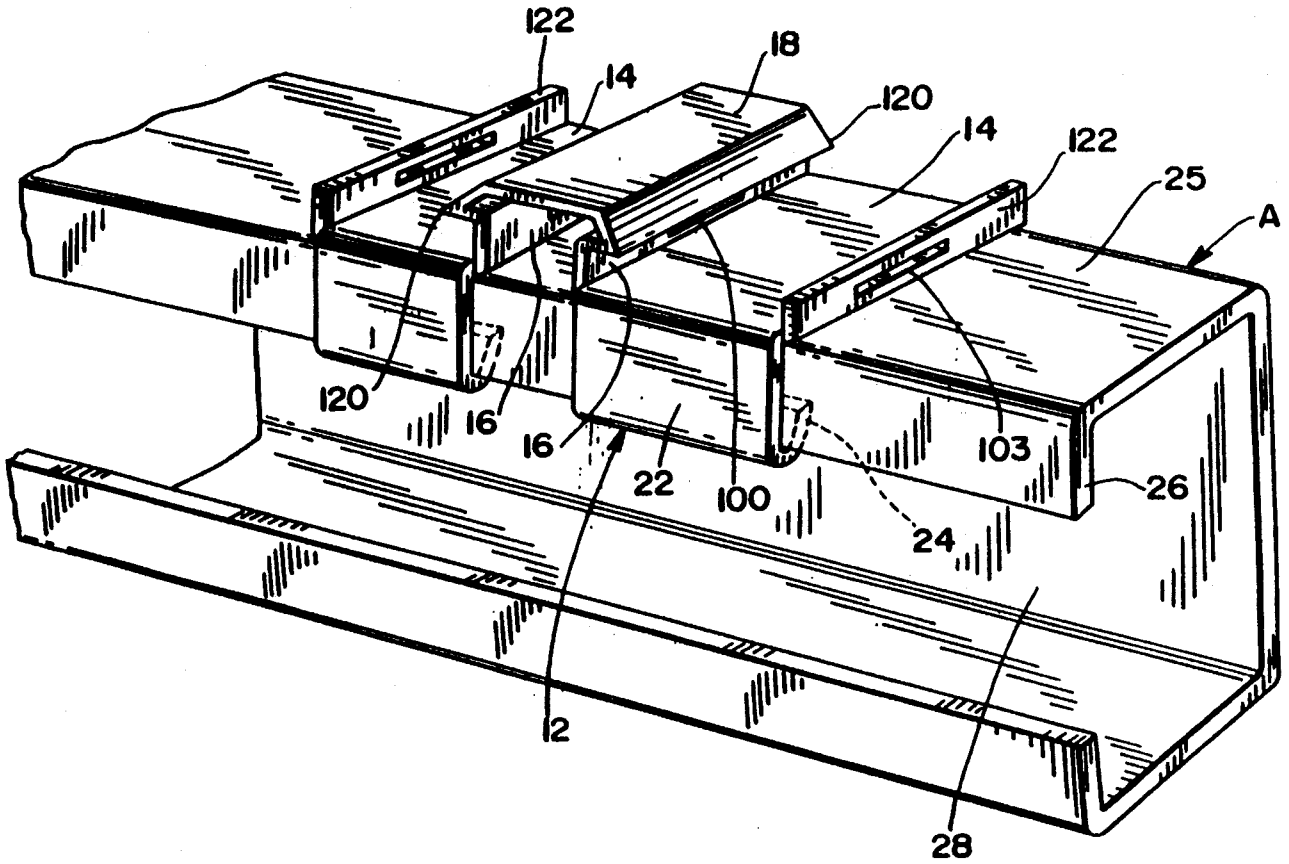
FIG. 26 is an enlarged perspective view showing a holding member in the embodiment of FIG. 25.

FIG. 25 shows a further embodiment of a device for incorporating a layer member in a face construction of a building according to the present invention. The embodiment shown in FIG. 25 comprises a holding member 12 and a mounting member 34. The holding member 12, as detailedly shown in FIG. 26, includes two base elements 14 held on a supporting member A made of a C-shaped steel in a relationship to be separated from each other. Each of the base plates 14 has the substantially same width as the supporting member A. The holding member 12 also includes a pair of connecting elements or plates 16 upwardly extending from the opposite ends of the base plates 14. The holding member 12 further includes a holding element 18 of a trapezoid shape supported on the upper end of each connecting plate 16 and having overhang portions 120 formed at the outer ends thereof. The connecting elements 16 and upwardly projecting portions 122 of the base plates 14 are respectively formed with through-holes 100 and 103 which are aligned with one another.

The base plates 14 each have a side plate portion 22 formed on one side thereof so as to downwardly extend therefrom. The side plate 22 is provided at the lower end thereof with a hook 24 which is adapted to engage with an upper one of flanges 26 of the C-shaped supporting member A defining an opening 28 therebetween to thereby securely fix the base plates 14 onto the supporting member A. The side plate 22 may be provided at the both sides of the base plate 12.

The holding member 12 is positioned and fixed with respect to the supporting member A in a manner to cause-the hook 24 of the side plate 22 and the base plate 14 to securely clamp the upper wall portion 25 and upper flange 26 of the supporting member A therebetween.

The mounting member 34 extends in the direction perpendicular to the supporting members A arranged in rows and is supported on the holding elements 18 of the adjacent holding members 12. The mounting member 34 is formed into a substantially inverted U-shape and has a flange 40 formed at each of the lower end portions thereof which extends in the longitudinal direction of the member 34. The flange 40 is preferably connected to the lower end of the inverted U-shaped portion of the mounting member 34 through an inwardly bent portion 96 interposed therebetween. The inwardly bent portion 96 is formed with a through-hole (not shown) corresponding to the through-holes 100 and 102. The mounting member 34 may be formed at the side walls thereof with through-holes (not shown) aligned with each other. Also, the mounting member 34 may be provided at the flat top surface 38 thereof with projecting pawls (not shown). In the illustrated embodiment, the mounting member 34 is not provided with any steps, however, it may be formed into a substantially convex shape having steps on the both sides thereof. The mounting member 34 is mounted on the holding member 12 by receiving the flanges 40 of the mounting member in recesses 70 formed by the connecting plates 16, base plates 14 and projections 122 and engaging the inwardly bent portions 96 of the mounting plate 34 with overhang portions 120 of the holding element 18.

The device shown in FIG. 25 may include a stopper 98 formed of a metal plate into the same doglegged shape as that shown in FIG. 15 or 19. The stopper 98 as shown in FIG. 15 is inserted at a part thereof into the inwardly bent portion 96 of the mounting member 34 received in the recess 70 of the holding member 12 and then hit with a hammer to be deformed into a flat shape, so that the stopper 98 is stretched between the inwardly bent portion 96 and the projecting end 122 of the base plate 14 to fix the mounting member 34 with respect to the holding member, as shown in FIG. 25. In FIG. 25, the stopper 98 penetrates at one end thereof the inwardly bent portion 96 of the mounting member 34 and outwardly projects at the other end thereof from the through-hole 103. The stopper 98 as shown in FIG. 19 is formed to have an acute end 104 and a round end 106. When the stopper 98 is hit with a hammer, the acute end 104 penetrates the inwardly bent portion 96 of the member 34 and projects via the through-hole 100 of the connecting plate 16, and the round end 106 outwardly projects via the through-hole 103, thus, the mounting member 34 is securely fixed with respect to the holding member 14.

The so-assembled device of the embodiment, as shown in FIG. 25, is used in such a manner to support an inner layer or an outer layer member formed of any desired material such as a heat insulating material, a sound absorbing material or the like on the opposite side projection 122 of the adjacent base plates 14, and hold a face member by means of the projecting pawls (not shown) of the flat top surface of the mounting member 34.

Figure 27:
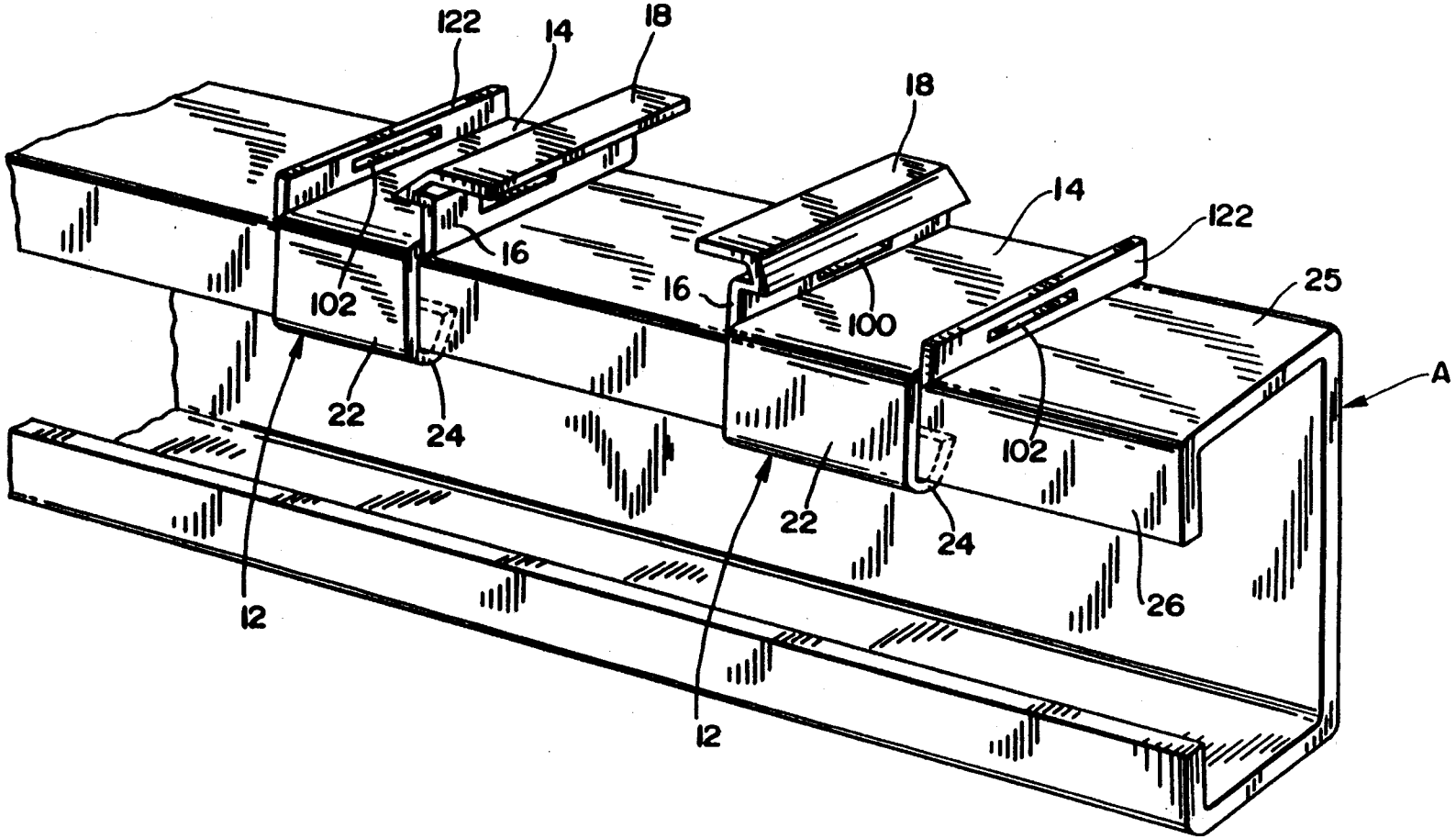
FIG. 27 is an enlarged perspective view showing a holding member in a modification of the device shown in FIG. 25, which is divided into two parts.
Figure 28:
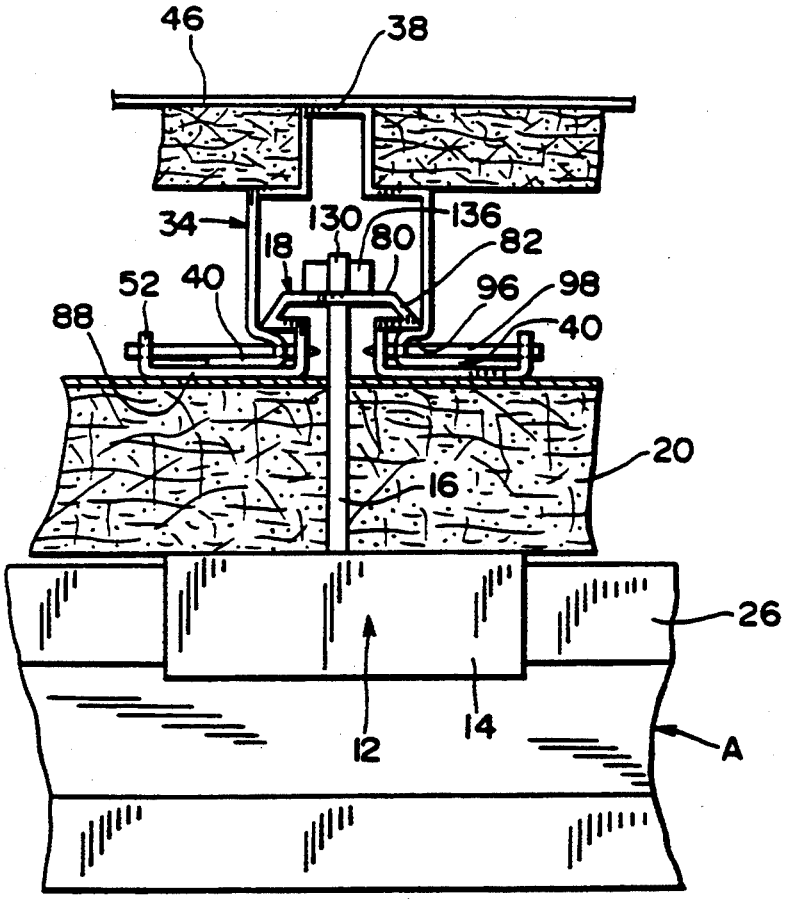
FIG. 28 is an elevation view showing still a further embodiment of a device for incorporating a layer member in a face construction of a building according to the present invention.

FIGS. 27 and 28 illustrate a modification of the embodiment shown in FIG. 25, wherein a base plate 14, a holding element 16, a side plate 22 and a hook 24 each comprises two halves symmetrically formed. In the practical use, the two parts of the holding member 12 are aligned with each other.

As can be seen from the foregoing, the device of the present embodiment constructed as described above can be easily manufactured because of requiring only a punching operation and a bending operation. Also, the device is capable of safely supporting a layer member, as compared with the conventional device adapted to support a layer member on a supporting member utilizing a hook bolt. Thus, the present embodiment is also capable of employing various kinds of layer members formed of a soft material as well as a hard material. Furthermore, the embodiment is easily positioned with respect to the supporting member even after it has been fixed on the supporting member, therefore, the embodiment allows the assembling of a face construction to be significantly facilitated.

FIG. 28 illustrates still a further embodiment of a device for incorporating a layer member in a face construction of a building according to the present invention. The embodiment illustrated comprises a holding member 12 supported on a supporting member A and a mounting member 34 held on the holding member 12. The holding member 12, as detailedly shown in FIG. 29, includes a base plate 14 held on the supporting member A and a connecting plate 16 mounted on the central portion of the base plate 14, for example, by welding so as to upwardly extend therefrom. The connecting plate 16 has a rectangular projection 130 formed integrally on the upper end thereof, which is formed with a through-hole 132. The base plate 14 is provided on one side thereof with a side plate portion 22 which downwardly extends therefrom. The side plate 22 has a hook 24 formed at the lower end thereof which is adapted to engage with an upper one of flanges 26 of the supporting member A defining an opening 28 therebetween to fix the base plate 14 on the supporting member A.

The holding member 12 also includes a holding element 14 which is mounted through the connecting plate 16 on the base plate 14. The holding element 18 has the substantially same width as the supporting member A and a length larger than that of the base plate 14. The holding element 18 is formed into a substantially omega (Ω) shape. More particularly, the holding element 18 has a flat top surface portion 80 which is formed at the central portion thereof with a through-hole 134 adapted to snugly fit the projection 130 of the connecting plate 16 therein. The holding element 18 also has a pair of obliquely outwardly descending portions or outwardly expanded portions 82 from the both ends of the flat top surface 80, a pair of horizontally inwardly extending portions 84 from the obliquely outwardly descending portion 82, a pair of downwardly extending portions or vertical portions 86 from the horizontally inwardly extending portions 84, a pair of flange portions 88 horizontally outwardly extending from the vertical portions 86, and a pair of upward projections 52 formed at the outer ends of the flanges 88. The portions 84 and 86 form a constriction. Also, the vertical portions 86, flange portions 88 and upward projections 52 form together recesses 70 adapted to receive a pair of flanges 40 of the mounting member 34 described hereinafter.

Each of the flange portions 88 is formed to allow a space to be defined between the flanges 88 and the base plate 14 which has the substantially same height as an inner member so that it may be securely received therein.

The base plate 14 is preferably formed at the side end thereof opposite to the side plate 22 with a downwardly projection 60 of a small length to allow the base plate 14 to be more effectively fixed with respect to the supporting member A. However, it should be noted that the base plate 14 is substantially fixed on the supporting member A by means of only the hook 24 without providing such projection 60.

The mounting member 34 extends in the direction perpendicular to the supporting members A arranged in rows and is supported on the holding elements 18 of the adjacent holding members 12. The mounting member 34 is formed into a substantially convex shape to have a pair of steps 36 and a flat top surface 38 and is formed at each of the lower end portions thereof with the flange 40 extending in the longitudinal direction thereof and adapted to be received in the recess 70. Each of the flanges 40 is preferably connected to the lower end of the convex-shaped portion of the mounting member 34 through an inwardly bent portion 96 interposed therebetween. The mounting member 34 may be provided at the lower side walls thereof with through-holes (not shown) and formed at the flat top surface 38 thereof with projecting pawls (not shown).

Reference numeral 98 designates a stopper element made of a metal plate and formed into the same dog-legged shape as that shown in FIG. 15. The holding element 18 of the holding member 12 is formed at the downwardly extending portion 86 and the upward projection 52 with through-holes 100 and 100*a*, respectively. The mounting member 34 also may be correspondingly formed at each of the inwardly bent portions 96 with a through-hole (not shown). When the stopper 98 is inserted in the recess 70 of the holding element 34 and then hit with a hammer to be deformed into a flat shape; one end of the stopper 98 inwardly projects via the through-hole (not shown) of the inwardly bent portion 96 of the mounting member 34 and the through-hole 100 of the downwardly extending portion 86 of the holding element 18, and the other end thereof outwardly projects via the through-hole 100*a* of the upward projection 90, to thereby fix the mounting member 34 with respect to the holding member 12. The stopper 98 may be formed to have an acute end and a round end formed in the same manner as in FIG. 19. In this instance, the acute end of the stopper 98, as shown in FIG. 28, penetrates the inwardly bent portion 96 of the mounting member 14 and the vertical portion 86 of the holding element 18, therefore, it is not required to form the through-holes at these portions.

Reference numeral 136 designates another stopper element made of an elastic material such as a metal sheet, which is adapted to be inserted into the through-hole 132 of the projection 130 after fitting the projection 130 in the through-hole 134, to thereby more effectively hold the mounting member 34 with respect to the holding member 12. The stopper 136 has a flat plate portion 138 and a W-shaped plate portion 140 connected at one end thereof to one end of the flat plate 138 and is inserted at the W-shaped plate portion 140 into the through-hole 132 of the projection 130.

Figure 29:
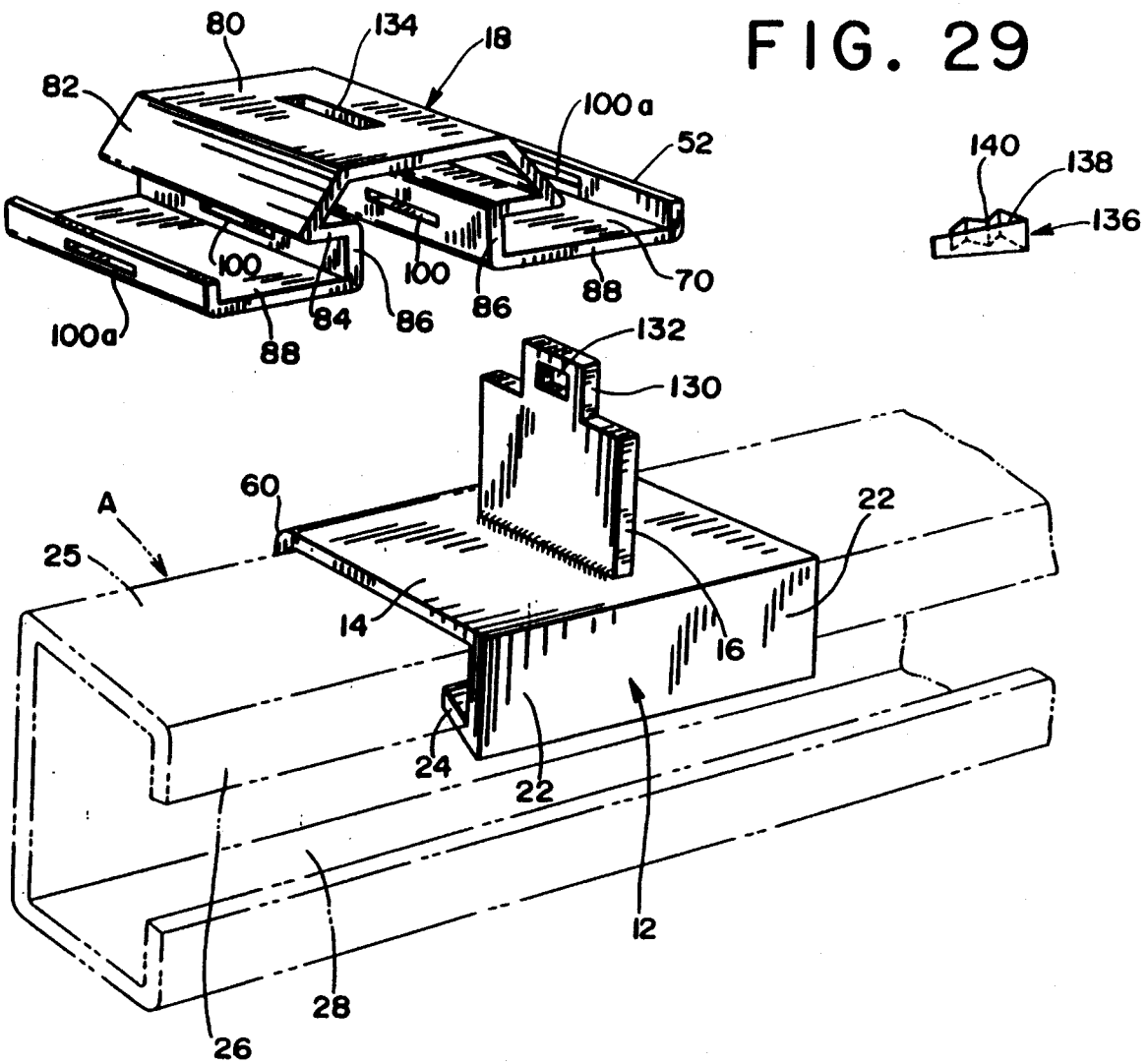
FIG. 29 is an enlarged exploded perspective view showing a holding member in the device shown in FIG. 28.
Figure 30:
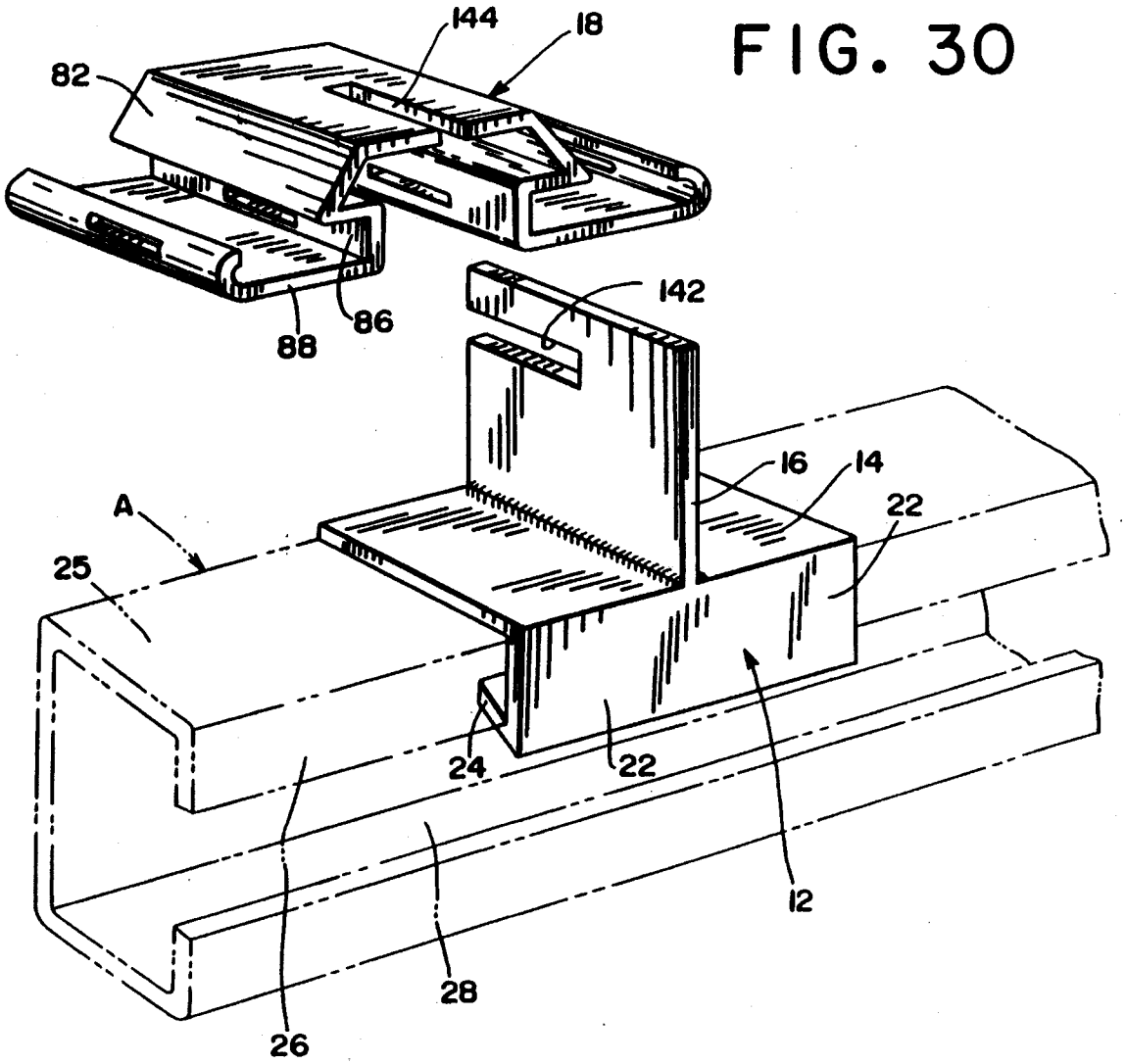
FIG. 30 is an enlarged exploded perspective view showing a holding member in a modification of the device shown in FIG. 28.

FIG. 30 illustrates a holding member in a modification of the embodiment shown in FIGS. 28 and 29. In the holding member 12 of the modification, a connecting plate 16 is formed at one side of the upper portion thereof with a rectangular cutout 142 and a top surface of a holding element 18 is correspondingly formed at the middle portion thereof with a cutout 144 which is engaged with the cutout 142 of the connecting plate 16.

Figure 31:
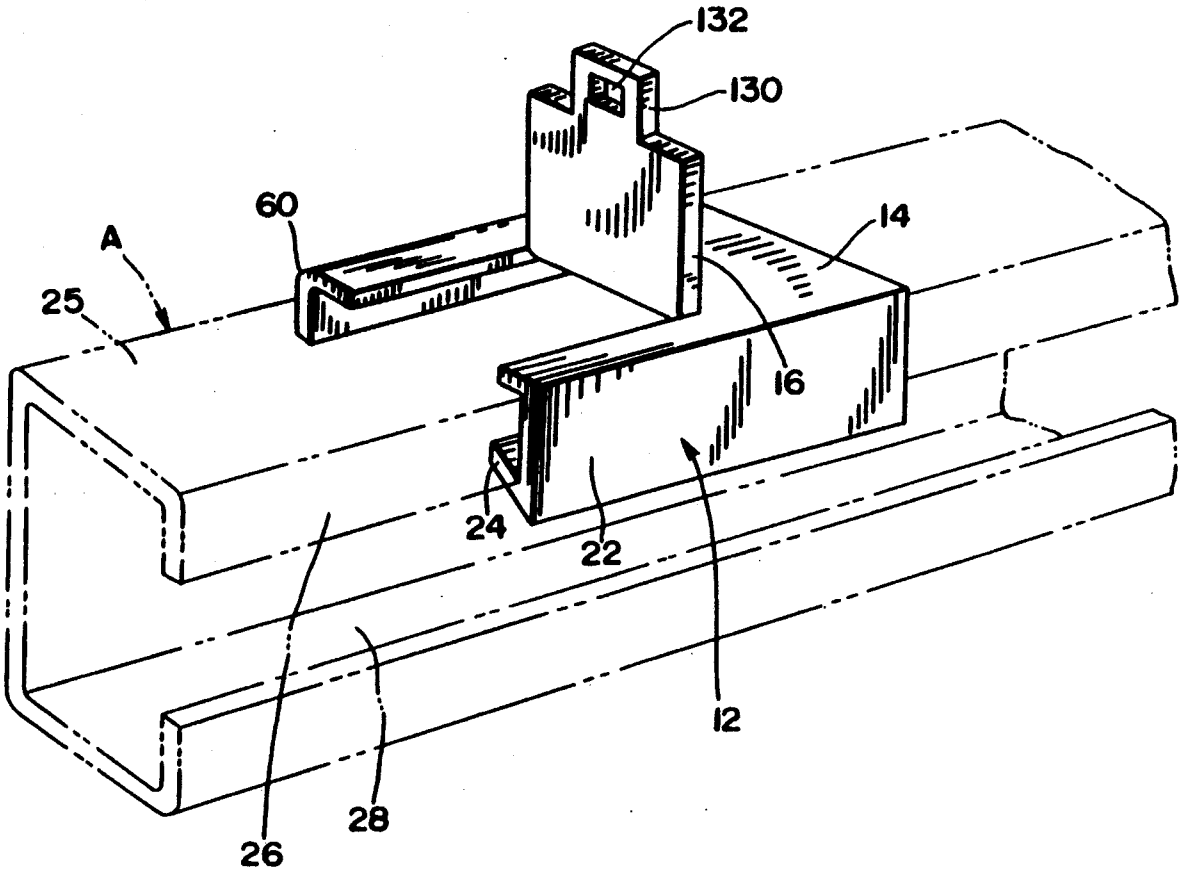
FIG. 31 is a perspective view showing a holding member in another modification of the device shown in FIG. 28.

FIG. 31 illustrates another modification of the embodiment shown in FIGS. 28 and 29. In the present modification, a connecting plate 16 is formed by cutting and raising one side of a base plate 14 in the longitudinal direction thereof.

It will be readily noted that the device of the embodiment shown in FIGS. 28 to 31 is used in the substantially same manner as the embodiments described hereinbefore.

As many apparently widely different embodiments of this invention may be made without departing from the spirit and scope thereof, it is to be understood that the invention is not limited to the specific embodiment thereof except as defined in the appended claims.

What is claimed is:

1. A device for incorporating a layer member in a face construction of a building comprising a C-shaped supporting member coupled to said building, said C-shaped supporting member having an upper wall, a lower wall, and a central wall having upper and lower sides extending therebetween, said upper wall having at least one flange extending substantially in a direction towards said lower wall from a position thereon spaced from said central wall, a base element provided with a hook means engaged about said upper wall of said C-shaped supporting member so that a portion of said hook means faces the lower side of said upper wall, said base element having a base portion facing the upper side of said upper wall, said base portion aiding in fixing said base element on said supporting member, a connecting element mounted on said base element and a holding element mounted by said connecting element on said base element; said base element being held on a supporting member of a building and to hold a layer member in cooperation with said connecting element and said holding element.

2. A device for incorporating a layer member in a face construction as defined in claim 1, wherein said holding element and said base element are spaced from each other through said connecting element with a space being defined therebetween which is sufficient to hold said layer member therein.

3. A device for incorporating a layer member in a face construction as defined in claim 2, wherein said base portion of said base element comprises a plate and is provided at one side thereof with said hook means which is engaged with said flange extending from said upper wall of said supporting member to fix said base element to said supporting member, said hook means being formed along the entire longitudinal direction of said base element.

4. A device for incorporating a layer member in a face construction of a building as defined in claim 3, wherein said hook means comprises a side plate downwardly extending from said base element and having a hook portion formed at the lower end thereof along the longitudinal direction thereof which engages said flange extending from said upper wall of said C-shaped supporting member.

5. A device for incorporating a layer member in a face construction of a building as defined in claim 4, wherein said connecting element comprises at least one rigid plate fixed on said element and upwardly extending therefrom.

6. A device for incorporating a layer member in a face construction of a building as defined in claim 5, wherein said base element and holding element have the substantially same width as said supporting member, and said connecting element is mounted on said base element in the direction perpendicular to said supporting member over the entire width of said supporting member.

7. A device for incorporating a layer member in a face construction of a building as defined in claim 4, wherein said connecting element comprises a pipe.

8. A device for incorporating a layer member in a face construction of a building as defined in claim 1, wherein said base element, connecting element and holding element are integrally formed of a plastic material.

9. A device for incorporating a layer member in a face construction of a building as defined in claim 1, wherein said base element, connecting element and holding element are divided into two substantially symmetrical parts about said connecting element.

10. A device for incorporating a layer member in a face construction of a building as defined in claim 1 further comprising a mounting member mounted on said holding member which is adapted to support at least a face member.

11. A device for incorporating a layer member in a face construction of a building as defined in claim 10, wherein said holding element is formed of a plate and is provided at the both side ends thereof with a pair of upward projections for positioning said mounting member thereon.

12. A device for incorporating a layer member in a face construction of a building as defined in claim 1 wherein said base element and a portion of said connecting element are integrally formed and comprise a bent rod, said bent rod having a portion defining said hook means and shaped to engage about said flange extending from said upper wall of said supporting member, a portion defining said base portion shaped to extend essentially parallel to the upper surface of said upper wall and a portion defining a portion of said connecting element extending from the base portion and terminating in a threaded bolt region, said connecting element including means for joining said holding element to said bolt region of said bent rod.

13. A device for incorporating a layer member in a face construction of a building comprising:

a C-shaped supporting member coupled to a building said C-shaped supporting member having an upper wall, a lower wall, and a central wall extending therebetween, said upper wall having at least one flange extending substantially in a direction towards said lower wall from a position thereon spaced from said central wall;

a holding member comprising a base plate supported on said C-shaped supporting member of said building, a connecting element upwardly extending from said base plate, and a holding element mounted on said base plate through said connecting element;

said base plate being formed at one side thereof with a hook means which comprises a side plate downwardly extending from said base plate and a hook formed by inwardly bending the lower end of said side plate so as to extend around said flange extending from said upper wall of said C-shaped supporting member;

said base plate having at at least one end formed thereof with an upward projection;

a mounting member removably mounted on said holding element of said holding member and adapted to support at least a layer member thereon; and a stopper element for fixing said mounting member with respect to said holding element of said holding member.

14. A device for incorporating a layer member in a face construction of a building as defined in claim 13, wherein said base plate is further provided on the outer side thereof opposite to said side plate with another side plate downwardly extending therefrom.

15. A device for incorporating a layer member in a face construction of a building as defined in claim 13, wherein said connecting element and said upward projection are respectively formed with through-holes for engagedly inserting the end portions of said stopper element.

16. A device for incorporating a layer member in a face construction of a building as defined in claim 13, wherein said holding member is vertically divided into two substantially symmetrical parts about said connecting element.

* * * * *